US009559398B2

(12) United States Patent
Hendry et al.

(10) Patent No.: US 9,559,398 B2
(45) **Date of Patent: *Jan. 31, 2017**

(54) MULTI-MODE FILTER

(75) Inventors: David Robert Hendry, Brisbane (AU); Steven John Cooper, Brisbane (AU); Peter Blakeborough Kenington, Chepstow (GB)

(73) Assignee: Mesaplex Pty Ltd., Queensland (AU)

( * ) Notice: Subject to any disclaimer, the term of this patent is extended or adjusted under 35 U.S.C. 154(b) by 400 days.

This patent is subject to a terminal disclaimer.

(21) Appl. No.: 13/488,234

(22) Filed: Jun. 4, 2012

(65) Prior Publication Data

US 2013/0049893 A1 Feb. 28, 2013

Related U.S. Application Data

(60) Provisional application No. 61/531,277, filed on Sep. 6, 2011.

(30) Foreign Application Priority Data

Aug. 23, 2011 (AU) ..... 2011903389

(51) Int. Cl.
*H01P 1/208* (2006.01)
*H01P 7/10* (2006.01)
*H01P 1/20* (2006.01)

(52) U.S. Cl.
CPC ..... *H01P 1/2086* (2013.01); *H01P 1/2088* (2013.01); *H01P 7/105* (2013.01); *H01P 1/2002* (2013.01); *Y10T 29/49016* (2015.01)

(58) Field of Classification Search
CPC ..... H01P 7/105; H01P 1/20; H01P 1/2086
USPC ..... 333/202, 219.1
See application file for complete search history.

(56) References Cited

U.S. PATENT DOCUMENTS

| | | | | |
|---|---|---|---|---|
| 2,890,421 | A | 6/1959 | Currie | |
| 3,657,670 | A | 4/1972 | Kitazume et al. | 333/73 W |
| 4,142,164 | A | 2/1979 | Nishikawa et al. | |
| 4,614,920 | A | 9/1986 | Tong | |
| 4,622,523 | A | 11/1986 | Tang | |
| 4,623,857 | A | 11/1986 | Nishikawa et al. | |

(Continued)

FOREIGN PATENT DOCUMENTS

| | | |
|---|---|---|
| CA | 1189154 A2 | 6/1985 |
| CA | 1194157 A1 | 9/1985 |

(Continued)

OTHER PUBLICATIONS

Fukunaga et al, Machine english translation of JP2002-135003, May 2002.*

(Continued)

*Primary Examiner* — Stephen E Jones
*Assistant Examiner* — Rakesh Patel
(74) *Attorney, Agent, or Firm* — Harrington & Smith

(57) ABSTRACT

A multi-mode cavity filter comprises: a dielectric resonator; a coupling structure for at least one of coupling input signals to the dielectric resonator and extracting filtered output signals from the dielectric resonator; a covering of conductive material around the dielectric resonator and comprising an aperture; and a printed circuit board structure having at least one ground plane layer arranged over said aperture and electrically coupled to the covering of conductive material.

13 Claims, 16 Drawing Sheets

(56) References Cited

U.S. PATENT DOCUMENTS

| | | | | | |
|---|---|---|---|---|---|
| 4,630,009 | A | | 12/1986 | Tang | |
| 4,644,305 | A | | 2/1987 | Tang et al. | |
| 4,675,630 | A | | 6/1987 | Tang et al. | |
| 4,792,771 | A | | 12/1988 | Siu | |
| 4,879,533 | A | | 11/1989 | de Muro et al. | 333/206 |
| 4,963,844 | A | * | 10/1990 | Konishi | H01P 1/207 333/202 |
| 5,023,866 | A | | 6/1991 | De Muro | 370/24 |
| 5,307,036 | A | | 4/1994 | Turunen et al. | 333/202 |
| 5,325,077 | A | | 6/1994 | Ishikawa et al. | 333/202 |
| 5,585,331 | A | | 12/1996 | Mansour et al. | |
| 5,589,807 | A | | 12/1996 | Tang | |
| 5,710,530 | A | | 1/1998 | Wada et al. | |
| 5,731,751 | A | | 3/1998 | Vangala | |
| 5,805,035 | A | | 9/1998 | Accatino et al. | |
| 5,821,837 | A | | 10/1998 | Accatino et al. | |
| 6,005,457 | A | | 12/1999 | Wu | |
| 6,016,091 | A | | 1/2000 | Hidaka et al. | 303/202 |
| 6,025,291 | A | | 2/2000 | Murakawa | 501/136 |
| 6,066,996 | A | | 5/2000 | Goertz et al. | |
| 6,072,378 | A | | 6/2000 | Kurisu et al. | |
| 6,133,808 | A | * | 10/2000 | Arakawa | 333/134 |
| 6,160,463 | A | | 12/2000 | Arakawa et al. | 333/202 |
| 6,278,344 | B1 | | 8/2001 | Kurisu et al. | |
| 6,346,867 | B2 | | 2/2002 | Arakawa et al. | 333/208 |
| 6,462,629 | B1 | | 10/2002 | Blair et al. | |
| 6,549,094 | B2 | | 4/2003 | Takagi et al. | 333/134 |
| 6,677,837 | B2 | | 1/2004 | Kojima et al. | 333/208 |
| 6,762,658 | B1 | | 7/2004 | Isomura et al. | 303/202 |
| 6,825,740 | B2 | | 11/2004 | Kundu | 333/202 |
| 6,834,429 | B2 | | 12/2004 | Blair et al. | |
| 6,853,271 | B2 | | 2/2005 | Wilber et al. | |
| 6,897,741 | B2 | | 5/2005 | Ando et al. | |
| 6,954,122 | B2 | | 10/2005 | Wilber et al. | |
| 7,042,314 | B2 | | 5/2006 | Wang et al. | 333/202 |
| 7,068,127 | B2 | | 6/2006 | Wilber et al. | |
| 7,138,891 | B2 | | 11/2006 | Andoh et al. | |
| 7,605,678 | B2 | | 10/2009 | Ando et al. | |
| 7,755,456 | B2 | | 7/2010 | Salehi | |
| 8,022,792 | B2 | | 9/2011 | Howard | |
| 8,325,077 | B2 | | 12/2012 | Gentric | 341/173 |
| 2001/0000429 | A1 | | 4/2001 | Arakawa et al. | 333/208 |
| 2001/0024147 | A1 | * | 9/2001 | Arakawa et al. | 333/135 |
| 2002/0024410 | A1 | | 2/2002 | Guglielmi et al. | 333/202 |
| 2002/0039058 | A1 | | 4/2002 | Sano et al. | 333/202 |
| 2003/0006864 | A1 | | 1/2003 | Hattori et al. | |
| 2003/0090344 | A1 | | 5/2003 | Wang et al. | 333/202 |
| 2003/0141948 | A1 | | 7/2003 | Maekawa et al. | |
| 2003/0227360 | A1 | | 12/2003 | Kirihara et al. | 333/239 |
| 2004/0041660 | A1 | | 3/2004 | Kawahara et al. | |
| 2004/0056736 | A1 | | 3/2004 | Enokihara et al. | 333/202 |
| 2005/0128031 | A1 | | 6/2005 | Wilber et al. | 333/202 |
| 2005/0140474 | A1 | | 6/2005 | Kim et al. | 333/219.1 |
| 2005/0253672 | A1 | * | 11/2005 | Enokihara et al. | 333/219.1 |
| 2006/0139127 | A1 | | 6/2006 | Wada et al. | |
| 2008/0018391 | A1 | * | 1/2008 | Bates | 327/557 |
| 2008/0061905 | A1 | | 3/2008 | Ishikawa | |
| 2008/0211601 | A1 | | 9/2008 | Bates | 333/186 |
| 2010/0231323 | A1 | | 9/2010 | Vangala et al. | |
| 2011/0006856 | A1 | | 1/2011 | Kim et al. | |
| 2011/0128097 | A1 | | 6/2011 | Park et al. | |
| 2014/0077900 | A1 | | 3/2014 | Rogozine et al. | 333/212 |

FOREIGN PATENT DOCUMENTS

| | | | | | |
|---|---|---|---|---|---|
| EP | 0883203 | A3 | | 10/1999 | |
| JP | H0216801 | | | 1/1990 | |
| JP | H-10284988 | | | 1/1998 | |
| JP | H-1079636 | | | 3/1998 | |
| JP | H-10209808 | | | 8/1998 | |
| JP | H-10224113 | | | 8/1998 | |
| JP | H-10294644 | | | 11/1998 | |
| JP | H-10322161 | | | 12/1998 | |
| JP | 2000295072 | A | | 10/2000 | |
| JP | 2001060804 | A | | 3/2001 | |
| JP | 2001060805 | A | | 3/2001 | |
| JP | 2001160702 | A | | 6/2001 | |
| JP | 2002-135003 | | * | 5/2002 | H01P 1/208 |
| JP | 2002151906 | A | | 5/2002 | |
| JP | 2002217663 | A | | 8/2002 | |
| JP | 2003037476 | A | | 2/2003 | |
| JP | 2003188617 | A | | 7/2003 | |
| JP | 2003234635 | A | | 8/2003 | |
| JP | 2004312287 | A | | 11/2004 | |
| JP | 2004312288 | A | | 11/2004 | |
| JP | 2005065040 | A | | 3/2005 | |
| JP | 2005167577 | A | | 6/2005 | |
| JP | 2005223721 | A | | 8/2005 | |
| WO | WO-9301626 | A1 | | 1/1993 | |
| WO | WO-0077883 | A1 | | 12/2000 | |
| WO | WO-02078119 | A1 | | 10/2002 | |

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

Awai, Ikuo, et al; Coupling of Dual Modes in a Dielectric Waveguide Resonator and its Application to Bandpass Filters; Proceedings of the 25th European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40th European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

Dupont, "Properties Handbook", Dupont, p. 4 (30 pgs.), Nov. 2003.

"DuPont™Tefzel® fluoropolymer resin", Properties Handbook, DuPont, Nov. 2003.

* cited by examiner

MULTI-MODE FILTER

CROSS REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, both of whose disclosures are hereby incorporated by reference in their entirety into the present disclosure.

TECHNICAL FIELD

The present invention relates to filters, and in particular to a multi-mode filter including a resonator body for use, for example, in frequency division duplexers for telecommunication applications.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode combline resonator coupled between two dielectric mono-bodies to form a hybrid filter assembly as described in U.S. Pat. No. 6,954,122. In any case the physical complexity and hence manufacturing costs are even further increased.

SUMMARY

According to an aspect of the present invention, there is provided a multi-mode cavity filter, comprising: a dielectric resonator; a coupling structure for coupling input signals to the dielectric resonator and/or for extracting filtered output signals from the dielectric resonator; a covering of conductive material around the dielectric resonator and comprising an aperture; and a printed circuit board structure having at least one ground plane layer arranged over said aperture and electrically coupled to the covering of conductive material.

The dielectric resonator may, for example, incorporate a piece of dielectric material, the piece of dielectric material having a shape such that it can support at least a first resonant mode and at least a second substantially degenerate resonant mode.

The coupling structure may, for example, be arranged for at least one of coupling input signals to the dielectric resonator through the aperture and extracting filtered output signals from the dielectric resonator through the aperture.

The coupling structure may, for example, comprise a first electrical connection on the surface of the dielectric resonator and a second electrical connection in a layer of the printed circuit board structure. The second electrical connection may, for example, be arranged in an outermost layer of the printed circuit board structure. The second electrical connection may, for example, be coupled to an inner signal layer of the printed circuit board structure.

The coupling structure may, for example, comprise at least one conductive track arranged on the surface of the dielectric resonator. The at least one conductive track may, for example, comprise a first portion for at least one of coupling signals to and extracting signals from a first resonant mode of the dielectric resonator and a second portion for at least one of coupling signals to and extracting signals from a second resonant mode of the dielectric resonator.

The printed circuit board structure may, for example, comprise a first ground plane layer electrically connected to the covering of conductive material and at least a second ground plane layer electrically coupled to the first ground plane layer. The first and second ground plane layers may, for example, be electrically coupled such that energy leakage from the dielectric resonator is reflected back into the dielectric resonator. The first ground plane layer may, for example, be continuously electrically coupled to the covering of conductive material around the aperture. The coupling structure may, for example, be electrically connected to an inner signal layer of the printed circuit board structure by a connection which passes through said first and second ground plane layers.

The printed circuit board structure may, for example, comprise a first printed circuit board and a second printed circuit board electrically coupled to each other.

The dielectric resonator may, for example, comprise a piece of dielectric material having a flat surface, and wherein the aperture is arranged on the flat surface.

According to an aspect of the present invention, there is provided a multi-mode cavity filter, comprising: at least one dielectric resonator body incorporating a piece of dielectric material, the piece of dielectric material having a shape such that it can support at least a first resonant mode and at least a second substantially degenerate resonant mode; a layer of conductive material in contact with and covering the dielectric resonator body; and a coupling structure comprising at least one electrically conductive coupling path for at least one of inputting signals to the dielectric resonator body and outputting signals from the dielectric resonator body, the at least one electrically conductive coupling path being arranged for at least one of directly coupling signals to the first resonant mode and the second substantially degenerate resonant mode in parallel, and directly coupling signals from the first resonant mode and the second substantially degenerate resonant mode in parallel.

The at least one electrically conductive coupling path may, for example, comprise at least one of an input coupling path and an output coupling path for respectively coupling signals to and from the dielectric resonator body.

The at least one coupling path may, for example, run substantially parallel to a surface of the dielectric resonator body. The at least one coupling path may, for example, lie adjacent the surface of the dielectric resonator body.

The at least one coupling path may, for example, comprise a first portion primarily for coupling to the first mode and a second portion primarily for coupling to the second mode. The first portion of the at least one coupling path may, for example, be oriented such that at least one of the magnetic field and the electric field generated by said first portion is substantially aligned with the respective magnetic field or electric field of said first mode. The second portion of the at least one coupling path may, for example, be oriented such that at least one of the magnetic field and the electric field generated by said second portion is substantially aligned with the respective magnetic field or electric field of said second mode. The first portion and second portion may, for example, be any of the following: a straight or curved elongate track, and a patch. The first portion may, for example, comprise a first straight elongate track and the second portion may, for example, comprise a second straight elongate track arranged substantially orthogonally to the first straight elongate track.

The at least one coupling path may, for example, comprise a portion for coupling simultaneously to both the first mode and the second mode. The portion may, for example, comprise an elongate track oriented at an angle such that at least one of the magnetic field and the electric field generated by said portion has a first Cartesian component aligned with the respective magnetic field or electric field of said first mode, and a second Cartesian component aligned with the respective magnetic field or electric field of said second mode.

The coupling structure may, for example, be formed in the layer of conductive material.

The multi-mode cavity filter may, for example, further comprise a substrate on which the dielectric resonator body is mounted. The coupling structure may, for example, be formed on the substrate. The substrate may, for example, comprise at least one of an input electrically coupled to said coupling structure for providing signals to the coupling structure and an output electrically coupled to said coupling structure for receiving filtered signals from the coupling structure. The substrate may, for example, comprise a printed circuit board.

The piece of dielectric material may, for example, comprise a substantially planar surface for mounting to the substrate. The coupling structure may, for example, be provided on or adjacent to said substantially planar surface.

The coupling structure may, for example, be provided on a substantially planar surface of said piece of dielectric material.

According to another aspect of the present invention there is provided a dielectric resonator body for a multi-mode cavity filter, the resonator including:

- a piece of dielectric material, with at least one substantially flat face for mounting on a substrate layer, the piece of dielectric material having a shape such that it can support at least a first resonant mode and at least one substantially degenerate resonant mode;
- wherein the shape of the piece of dielectric material is such that the first resonant mode and the at least one substantially degenerate resonant mode are capable of being simultaneously independently excited, and
- wherein the piece of dielectric material is at least partially covered with a layer of conductive material.

The dielectric material may have at least two axes and the each resonant mode is at least partially in the direction of a respective axis. Preferably, the dielectric body has three axes and supports three resonant modes that are substantially in the direction of said axes.

The piece of dielectric material may have at least one axis of symmetry. The axis of symmetry may be in respect of rotational or reflection symmetry.

The piece of dielectric material may have a shape arranged such that, in conjunction with its associated coupling structures, each resonant mode has a different centre frequency to the remaining resonant modes. Additionally, the piece of dielectric material may have a shape arranged such that each resonant mode has a centre frequency adjacent to another one of the resonant modes. Furthermore, the piece of dielectric material may have a respective major axis corresponding to each resonant mode and is asymmetric about at least one of the major axes.

The piece of dielectric material may have one or more further surfaces in addition to the flat face, each further surface being substantially even.

The piece of dielectric material may comprise one of a polyhedron, cuboid, cylinder, a hemisphere (or other portion of a sphere), prism, pyramid or any form of extruded shape.

The piece of dielectric material may include a ceramic material.

According to a further aspect of the present invention there is provided a multi-mode cavity filter including:

a dielectric resonator body for a multi-mode cavity filter, the resonator including:

a piece of dielectric material, with at least one substantially flat face for mounting on a substrate layer, the piece of dielectric material having a shape such that it can support at least a first resonant mode and at least one substantially degenerate resonant mode;

wherein the shape of the piece of dielectric material is such that the first resonant mode and the at least one substantially degenerate resonant mode are capable of being independently excited simultaneously, and wherein the piece of dielectric material is at least partially covered with a layer of conductive material; and a coupling structure comprising at least one electrically conductive coupling path for inputting signals to and/or outputting signals from the dielectric resonator body, the at least one electrically conductive coupling path being coupled to the substantially flat face.

The dielectric material may have at least two axes and the each resonant mode is at least partially in the direction of a respective axis.

The piece of dielectric material may have a shape arranged such that, in conjunction with its associated coupling structures, each resonant mode has a different centre frequency to the remaining resonant modes. Additionally, the piece of dielectric material may have a shape arranged such that each resonant mode has a centre frequency adjacent to another one of the resonant modes. Also, the piece of dielectric material may have a respective major axis corresponding to each resonant mode and is asymmetric about at least one of the major axes.

The piece of dielectric material may have one or more further surfaces in addition to the flat face, each further surface being substantially even.

The piece of dielectric material may comprise one of a polyhedron, a cuboid, a cylinder, a hemisphere (or other portion of a sphere), prism, pyramid or any form of extruded shape.

According to various embodiments of another aspect of the present invention, there is provided a multi-mode cavity filter, comprising: at least one dielectric resonator body incorporating a piece of dielectric material, the piece of dielectric material having a shape such that it can support at least a first resonant mode and at least a second substantially degenerate resonant mode; and a coupling structure comprising a patterned conductive layer for at least one of coupling signals to the piece of dielectric material and coupling signals from the piece of dielectric material.

The patterned conductive layer may, for example, be substantially in contact with the dielectric resonator body.

The patterned conductive layer may, for example, comprise at least one of an input coupling path and an output coupling path for respectively coupling signals to and from the dielectric resonator body. The input coupling path and/or the output coupling path may, for example, be for directly coupling signals to or from the first mode and the second mode in parallel.

The input coupling path and/or the output coupling path may, for example, comprise a first portion primarily for coupling to the first mode and a second portion primarily for coupling to the second mode. The first portion of the input coupling path and/or the output coupling path may, for example, be oriented such that at least one of the magnetic field and the electric field generated by said first portion is substantially aligned with the respective magnetic field or electric field of said first mode, and the second portion of the input coupling path and/or the output coupling path may be oriented such that at least one of the magnetic field and the electric field generated by said second portion is substantially aligned with the respective magnetic field or electric field of said second mode.

The first portion and second portion may, for example, be any of the following: a straight or curved elongate track, and a patch. The first portion may comprise a first straight elongate track and the second portion may comprise a second straight elongate track arranged substantially orthogonally to the first straight elongate track.

The input coupling path and/or the output coupling path may, for example, comprise a portion for coupling simultaneously to both the first mode and the second mode. The portion may, for example, comprise an elongate track oriented at an angle such that at least one of the magnetic field and the electric field generated by said portion has a first Cartesian component aligned with the respective magnetic field or electric field of said first mode, and a second Cartesian component aligned with the respective magnetic field or electric field of said second mode.

The patterned conductive layer may, for example, form part of a coating covering the piece of dielectric material.

The multi-mode cavity filter may further comprise a substrate on which the dielectric resonator body is mounted. The patterned conductive layer may be formed on the substrate. The substrate may, for example, comprise at least one of an input electrically coupled to said coupling structure for providing signals to the coupling structure and an output electrically coupled to said coupling structure for receiving filtered signals from the coupling structure.

The substrate may, for example, comprise a printed circuit board.

The piece of dielectric material may comprise a substantially planar surface for mounting to the substrate. The patterned conductive layer may, for example, be provided on said substantially planar surface.

The patterned conductive coating may, for example, be provided on a substantially planar surface of said piece of dielectric material. The patterned conductive coating may comprise an input coupling path and an output coupling path for respectively coupling signals to and from the dielectric resonator body.

In a further aspect of the present invention, there is provided a method of manufacturing a multi-mode cavity filter, comprising: providing at least one dielectric resonator body incorporating a piece of dielectric material, the piece of dielectric material having a shape such that it can support at least a first resonant mode and at least a second substantially degenerate resonant mode; and forming a patterned conductive layer comprising a coupling structure for at least one of coupling signals to the dielectric resonator body and coupling signals from the dielectric resonator body.

The step of forming a patterned conductive layer may, for example, comprise: coating the piece of dielectric material with conductive material; and etching said coating to form said coupling structure.

The step of forming a patterned conductive layer may, for example, comprise: printing, depositing or painting said piece of dielectric material with conductive material to form said coupling structure.

The step of forming a patterned conductive layer may, for example, comprise: forming a patterned conductive layer in a substrate on which the piece of dielectric material is mounted.

According to some embodiments, the invention provides a multi-mode cavity filter, comprising a resonator body of dielectric material capable of supporting at least two degenerate electromagnetic wave propagation modes and having a face, and a conductive pattern on at least part of the face for coupling a radio frequency signal between the pattern and the resonator body. The body might have more than one face. Using a conductive pattern on the body to couple radio frequency signals to and/or from the body can provide for a relatively simple construction in that the body does not need to be worked to create ports or the like for accommodating conductive connections. Moreover, such a pattern can, in some embodiments, be used to provide both an input for launching a radio frequency signal into the resonator body and an output for receiving a radio frequency signal from the resonator body, meaning that the cavity filter can have a relatively compact construction.

The pattern may, for example, be a layer. The pattern may, for example, be a coating on the face. The pattern may, for example, form part of a conductive covering over the resonator body.

The pattern may, for example, include a first part and a second part and the first and second parts are electrically isolated from one another. For example, the first and second parts may be, respectively, an input for launching the signal into the resonator body and an output for recovering the signal from the resonator body.

The pattern may, for example, include a first part and a second part, where the first part is an input for launching the signal into the resonator body and the second part is an output for recovering the signal from the resonator body.

The part of the face on which the pattern resides may, for example, be flat.

The pattern may, for example, be provided on a substrate. The substrate may, for example, be a printed circuit board.

In some embodiments, the pattern includes an elongate path for launching the signal into the resonator body, the path having an open-circuited end. Such a path may, for example, include first and second parts, each part being for coupling the signal to a standing wave in a respective one of two non-interfering electromagnetic wave modes within the resonator body. Such non-interfering electromagnetic waves are sometimes referred to as 'orthogonal', however this does not necessarily imply that they have a 90 degree spatial relationship one with another. The first part may, for example, be elongate and the second part may, for example, be a patch, or the first and second parts may, for example, both be elongate and extend in different, possibly orthogonal, directions. At least one of the parts may, for example, be straight.

In some embodiments, the pattern includes another elongate path such that there are first and second elongate paths, wherein the first and second paths serve respectively as an input for launching the signal into the resonator body and an output for coupling the signal out of the resonator body.

According to some embodiments, the invention provides a method of manufacturing a multi-mode cavity filter, the method comprising providing a resonator body of dielectric material capable of supporting at least two degenerate electromagnetic propagation modes and having a face, and providing a conductive pattern on at least part of the face for coupling a radio frequency signal between the pattern and the resonator body.

Providing the pattern may, for example, involve coating at least part of the face with conductive material and removing part of the coating to form the pattern.

Providing the pattern may, for example, involve at least one of painting, depositing and printing the pattern on at least part of the face.

Providing the pattern may, for example, involve providing the pattern on a substrate and offering the substrate to the face.

According to another aspect of the present invention there is provided a dielectric resonator body for a multi-mode cavity filter, the resonator body including:

- a piece of first dielectric material, with at least one substantially flat face for mounting on a substrate, the piece of first dielectric material having a shape such that it can support at least a first resonant mode and at least one spurious response; and
- a layer of conductive material at least partially coating the resonator body;
- wherein the piece of first dielectric material includes at least one region having a different dielectric constant to the first dielectric material, whereby the presence of the region of different dielectric constant alters the frequency separation of the resonant mode and the spurious response.

The region of different dielectric constant may have a lower dielectric constant relative to the first dielectric material, whereby the frequency separation of the first resonant mode and the spurious response is increased.

The shape of the first dielectric material may include a plurality of surfaces and supports a plurality of resonant modes, the resonator body including at least one of said regions of different dielectric constant on at least one of the surfaces. The region of different dielectric constant may be located at an area of the respective surface at which the field distribution of the spurious response is more concentrated than that of the first resonant mode. The resonator body may be cuboid and the region of different dielectric constant located at the centre of the respective surface.

The region of different dielectric constant may comprise a piece of second dielectric material secured adjacent to the piece of first dielectric material. The piece of second dielectric material may protrude from the surface of the first piece of dielectric material. Alternatively, the piece of second dielectric material may be located within a recess formed in the first piece of dielectric material. Alternatively, the piece of second dielectric material may encapsulate the first piece of dielectric material.

The resonator body may further comprise at least one piece of third dielectric material secured adjacent to the piece of second dielectric material, the second and third dielectric materials having different dielectric constants.

The piece of second dielectric material may be shaped as one of the following: a cylinder, a cuboid, a polyhedron, a portion of a sphere and a prism.

The piece of second dielectric material may be bonded to the first dielectric material. Alternatively, the piece of second dielectric material may be mechanically secured adjacent to the first dielectric material.

Alternatively, the region of different dielectric constant may comprise a gas filled space covered by said conductive material.

The gas filled space may be defined by at least one recess formed in the first dielectric material. Alternatively, the gas filled space may be defined by at least one hollow shaped portion of said conductive material affixed to the surface of the first dielectric material.

According to a further aspect of the present invention there is provided a method of manufacturing a dielectric resonator body for a multi-mode cavity filter, the method comprising:

providing a piece of first dielectric material, with at least one substantially flat face for mounting on a substrate, the piece of first dielectric material having a shape such that it can support at least a first resonant mode and at least one spurious response; and providing a layer of conductive material at least partially coating the resonator body;

wherein the piece of first dielectric material includes at least one region having a different dielectric constant to the first dielectric material, whereby the presence of the region of different dielectric alters the frequency separation of the resonant mode and the spurious response.

The region of different dielectric constant may have a lower dielectric constant relative to the first dielectric material, whereby the frequency separation of the first resonant mode and the spurious response is increased.

The region of different dielectric constant may comprise a piece of second dielectric material secured adjacent to the piece of first dielectric material. The second dielectric material may be bonded to the surface of the first dielectric material.

Alternatively, the piece of second dielectric material may be mechanically secured adjacent to the first dielectric material.

Alternatively, one or more recesses may be formed in the first dielectric material and the second dielectric material is located within the recesses.

The piece of second dielectric material may encapsulate the first piece of dielectric material.

The step of providing the layer of conductive material may include providing a layer of the conductive material coating the first dielectric material; subsequently removing portions of the conductive layer at one or more locations; and adhering respective pieces of the second dielectric material to the first dielectric material at said locations.

The step of providing the layer of conductive material may alternatively include providing a layer of conductive material in a predefined pattern on the first dielectric material, the pattern including selected regions where no conductive material is provided; and subsequently securing respective pieces of the second dielectric material adjacent to the first dielectric material at said selected regions.

The respective pieces of the second dielectric material may be partially coated in the conductive material prior to being secured adjacent to the first dielectric material.

The region of different dielectric constant may be formed by creating one or more recesses in the first dielectric material prior to providing said conductive layer. The recess may be covered with a planar conductive element.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1A:
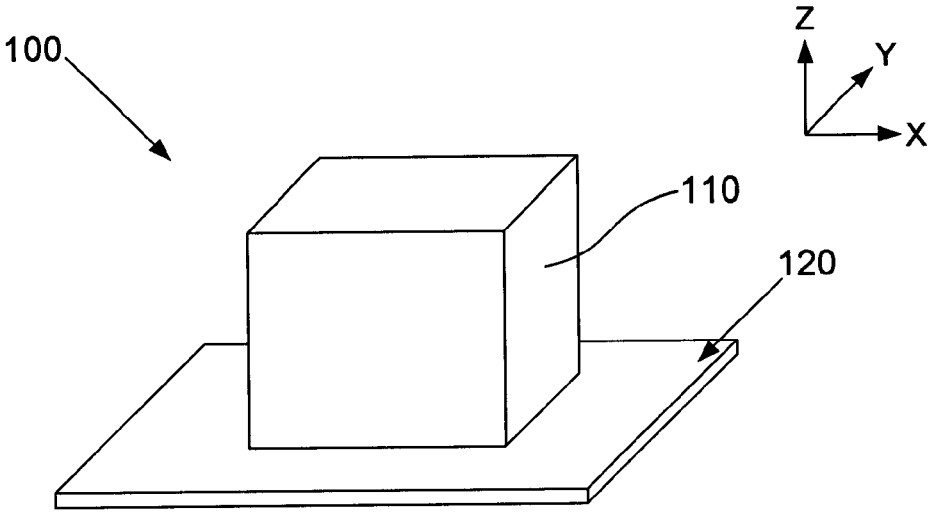
FIG. 1A is a schematic perspective view of an example of a multi-mode filter.
Figure 1B:
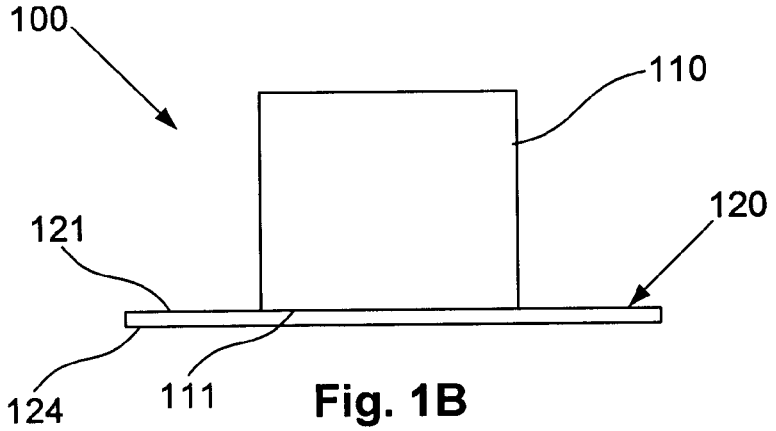
FIG. 1B is a schematic side view of the multi-mode filter of FIG. 1A.
Figure 1C:
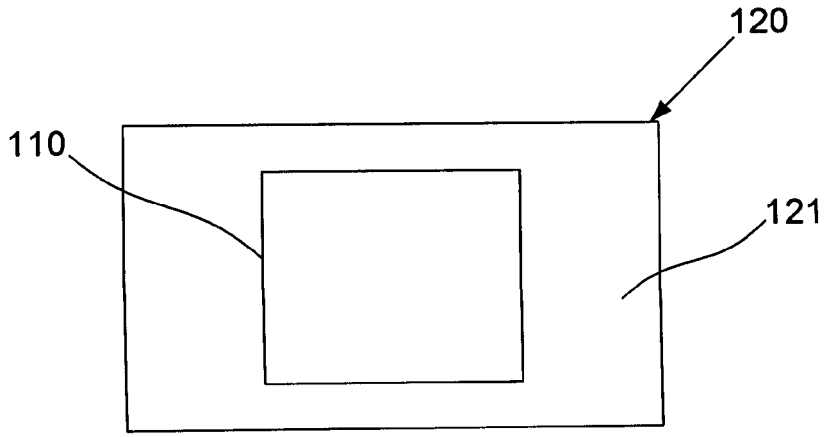
FIG. 1C is a schematic plan view of the multi-mode filter of FIG. 1A.

An example of a multi-mode filter will now be described with reference to FIGS. 1A to 1E.

In this example, the filter 100 includes a resonator body 110, and a coupling structure 130. The coupling structure 130 at least one coupling path 131, 132, which includes an electrically conductive resonator path extending adjacent at least part of a surface 111 of the resonator body 110, so that the coupling structure 130 provides coupling to a plurality of the resonance modes of the resonator body.

In use, a signal can be supplied to or received from the at least one coupling path 131, 132. In a suitable configuration, this allows a signal to be filtered to be supplied to the resonator body 110 for filtering, or can allow a filtered signal to be obtained from the resonator body, as will be described in more detail below.

The use of electrically conductive coupling paths 131, 132 extending adjacent to the surface 111 allows the signal to be coupled to a plurality of resonance modes of the resonator body 110. This allows a more simplified configuration of resonator body 110 and coupling structures 130 to be used as compared to traditional arrangements. For example, this avoids the need to have a resonator body including cut-outs or other complicated shapes, as well as avoiding the need for coupling structures that extend into the resonator body. This, in turn, makes the filter cheaper and simpler to manufacture, and can provide enhanced filtering characteristics. In addition, the filter is small in size, typically of the order of 6000 $mm^3$ per resonator body, making the filter apparatus suitable for use at the top of antenna towers.

A number of further features will now be described.

In the above example, the coupling structure 130 includes two coupling paths 131, 132, coupled to an input 141, an output 142, thereby allowing the coupling paths to act as input and output coupling paths respectively. In this instance, a signal supplied via the input 141 couples to the resonance modes of the resonator body 110, so that a filtered signal is obtained via the output 142. However, the use of two coupling paths is for the purpose of example only, and one or more coupling paths may be used depending on the preferred implementation.

For example, a single coupling path 131, 132 may be used if a signal is otherwise coupled to the resonator body 110. This can be achieved if the resonator body 110 is positioned in contact with, and hence is coupled to, another resonator body, thereby allowing signals to be received from or supplied to the other resonator body. Coupling structures may also include more coupling paths, for example if multiple inputs and/or outputs are to be provided, although alternatively multiple inputs and/or outputs may be coupled to a single coupling path, thereby allowing multiple inputs and/or outputs to be accommodated.

Alternatively, multiple coupling structures 130 may be provided, with each coupling structure 130 having one or more coupling paths. In this instance, different coupling structures can be provided on different surfaces of the resonator body. A further alternative is for a coupling structure to extend over multiple surfaces of the resonator body, with different coupling paths being provided on different surfaces, or with coupling paths extending over multiple surfaces. Such arrangements can be used to allow a particular configuration of input and output to be accommodated, for example to meet physical constraints associated with other equipment, or to allow alternative coupling arrangements to be provided. In use, a configuration of the input and output coupling paths 131, 132, along with the configuration of the resonator body 110 controls a degree of coupling with each of the plurality of resonance modes and hence the properties of the filter, such as the frequency response.

The degree of coupling depends on a number of factors, such as a coupling path width, a coupling path length, a coupling path shape, a coupling path direction relative to the resonance modes of the resonator body, a size of the resonator body, a shape of the resonator body and electrical properties of the resonator body. It will therefore be appreciated that the example coupling structure and cube configuration of the resonator body is for the purpose of example only, and is not intended to be limiting.

Typically the resonator body 110 includes, and more typically is manufactured from a solid body of a dielectric material having suitable dielectric properties. In one example, the resonator body is a ceramic material, although this is not essential and alternative materials can be used. Additionally, the body can be a multilayered body including, for example, layers of materials having different dielectric properties. In one example, the body can include a core of a dielectric material, and one or more outer layers of different dielectric materials.

The resonator body 110 usually includes an external coating of conductive material, such as silver, although other materials could be used such as gold, copper, or the like. The conductive material may be applied to one or more surfaces of the body. A region of the surface adjacent the coupling structure may be uncoated to allow coupling of signals to the resonator body.

The resonator body can be any shape, but generally defines at least two orthogonal axes, with the coupling paths extending at least partially in the direction of each axis, to thereby provide coupling to multiple separate resonance modes.

Figure 2A:
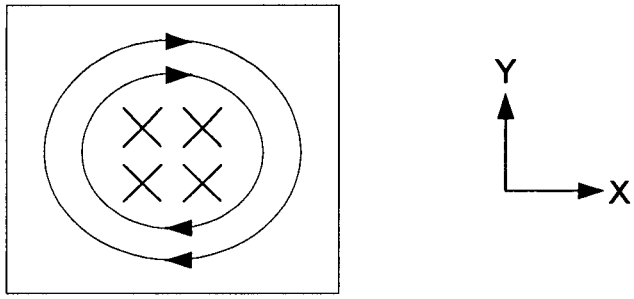
FIGS. 2A to 2C are schematic diagrams of examples the resonance modes of the resonator body of FIG. 1A.
Figure 2B:
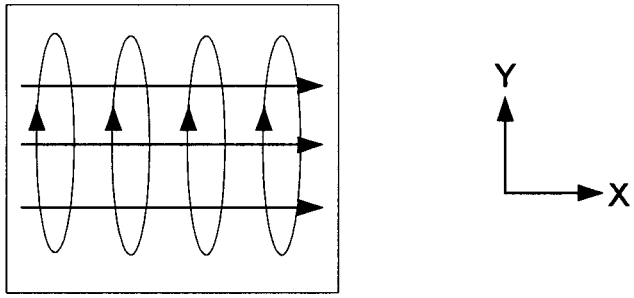
Figure 2C:
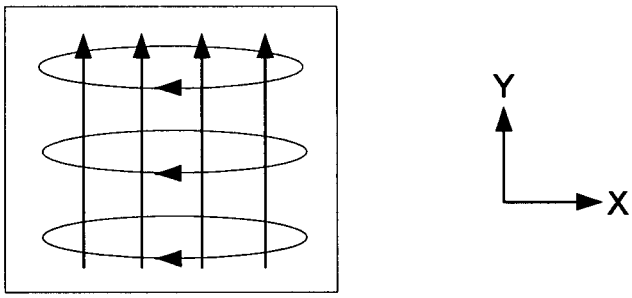

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

In this example, each coupling path 131, 132 includes a first path 131.1, 132.1 extending in a direction parallel to a first axis of the resonator body, and a second path 131.2, 132.2, extending in a direction parallel to a second axis orthogonal to the first axis. Each coupling path 131, 132 also includes an electrically conductive coupling patch 131.3, 132.3.

Thus, with the surface 111 provided on an X-Y plane, each coupling path includes first and second paths 131.1, 131.2, 132.1, 132.2, extending in a plane parallel to the X-Y plane and in directions parallel to the X and Y axes respectively. This allows the first and second paths 131.1, 131.2, 132.1, 132.2 to couple to first and second resonance modes of the resonator body 110. The coupling patch 131.1, 131.2, defines an area extending in the X-Y plane and is for coupling to at least a third mode of the resonator body, as will be described in more detail below.

Figure 14A:
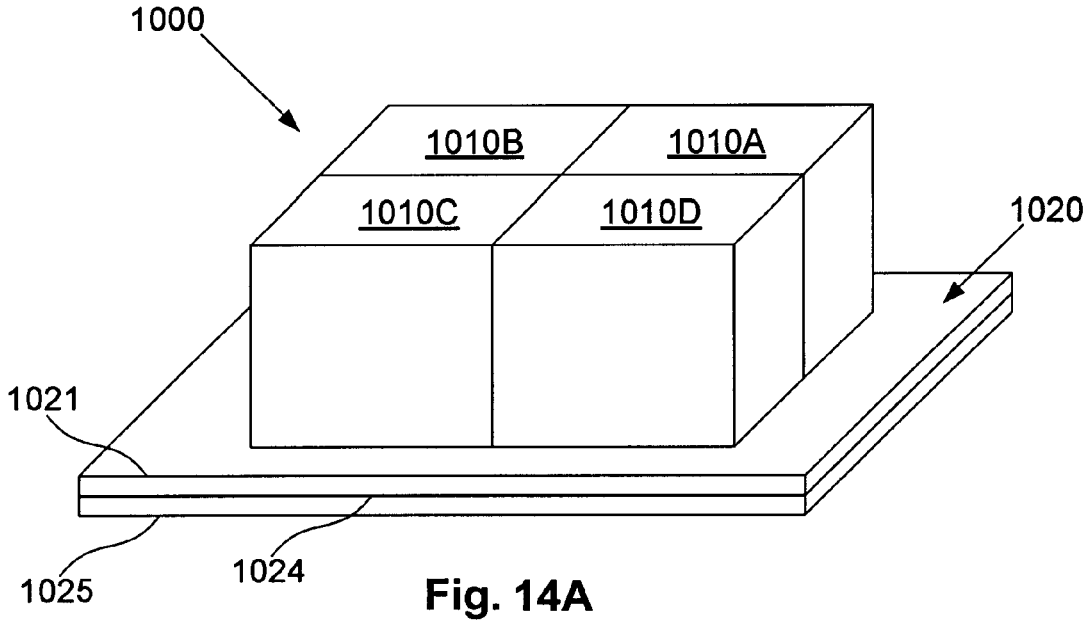
FIG. 14A is a schematic perspective view of an example of a multi-mode filter using multiple resonator bodies to provide filtering for transmit and receive channels.
Figure 14B:
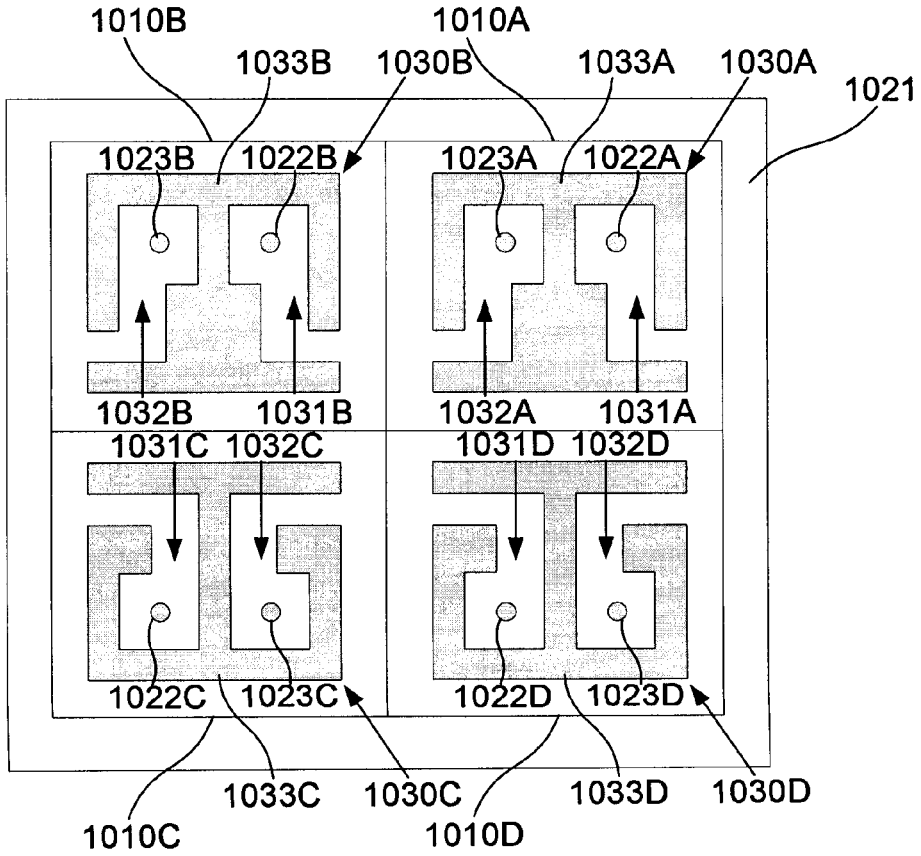
FIG. 14B is a schematic plan view of an example of the substrate of FIG. 14A including multiple coupling structures; and, FIG. 14C is a schematic underside view of an example of the substrate of FIG. 14A including inputs and outputs.

Cuboid structures are particularly advantageous as they can be easily and cheaply manufactured, and can also be easily fitted together, for example by arranging multiple resonator bodies in contact, as will be described below with reference to FIG. 14A. Cuboid structures typically have clearly defined resonance modes, making configuration of the coupling structure more straightforward. Additionally, the use of a cuboid structure provides a planar surface 111 so that the coupling paths can be arranged in a plane parallel to the planar surface 111, with the coupling paths optionally being in contact with the resonator body 110. This can help maximise coupling between the coupling paths and resonator body 110, as well as allowing the coupling structure 130 to be more easily manufactured.

For example, the coupling paths may be provided on a substrate 120. In this instance, the provision of a planar surface 111 allows the substrate 120 to be a planar substrate, such as a printed circuit board (PCB) or the like, allowing the coupling paths 131, 132 to be provided as conductive paths on the PCB. In that case, the one or more coupling structures can be formed in a conductive layer of the PCB using any of the standard techniques known to those skilled in the art, such as by patterning a mask in the layer (using printing techniques or photoresist) and then etching the exposed parts to create one or more cut-outs. Alternatively, the coupling structures may be formed by milling the conductive layer.

However, alternative arrangements can be used, such as coating the coupling structures onto the resonator body 110 directly. That is, the resonator body 110 may be coated in a layer of conductive material as described above. One or more coupling structures according to embodiments of the present invention can be patterned into the layer of conductive material, and coupled to input and/or output connections on an uppermost surface of the substrate 120. In that case, the coupling between the substrate 120 and the coupling structure on the resonator body may be provided by way of solder ball contacts or any other suitable means. The one or more coupling structures in the coating surrounding the resonator body 110 can again be formed using one of the standard techniques known to those skilled in the art, such as by patterning a mask (using printing techniques or photoresist) and then etching the exposed parts to create the coupling structure(s). Again, alternatively the coupling structures may be milled into the conductive layer surrounding the resonator body 110.

Figure 1D:
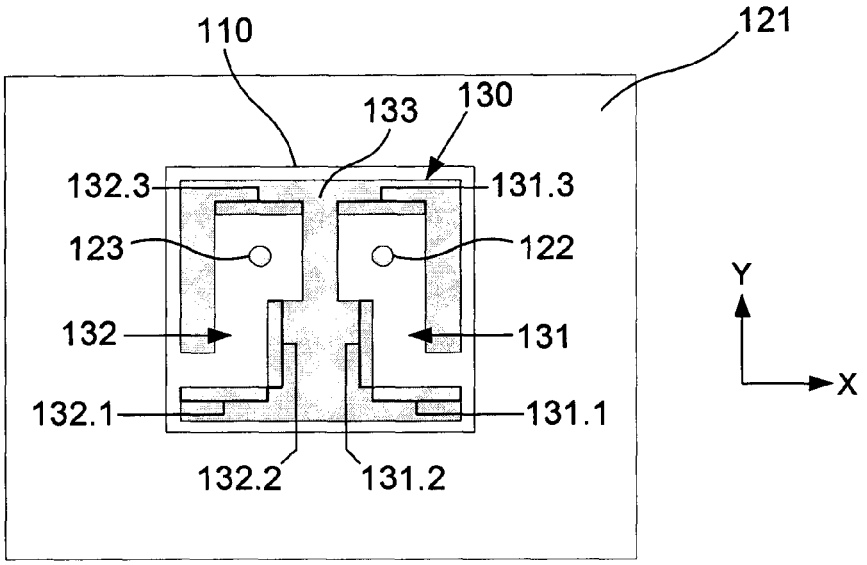
FIG. 1D is a schematic plan view of an example of the substrate of FIG. 1A including a coupling structure.
Figure 1E:
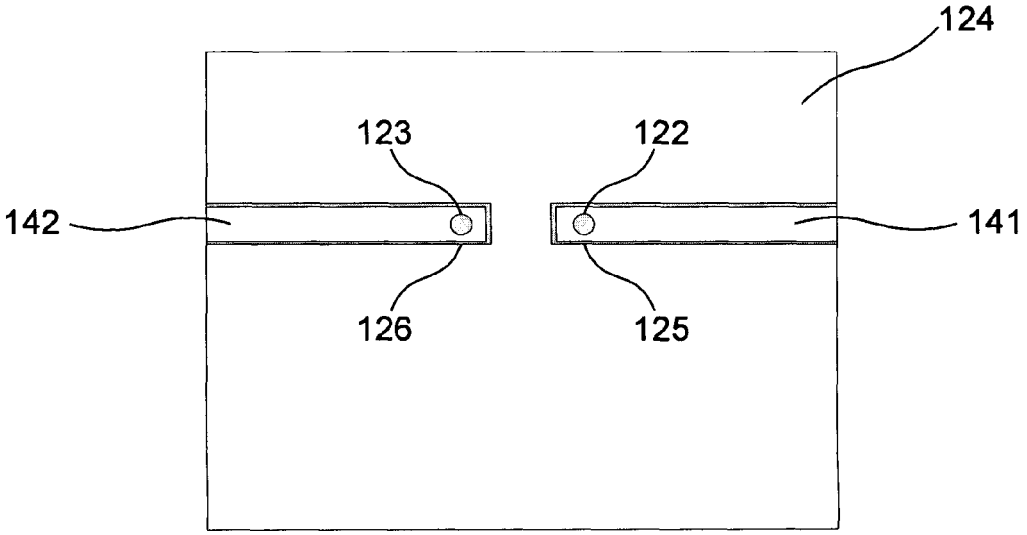
FIG. 1E is a schematic underside view of an example of the substrate of FIG. 1A including inputs and outputs.

In the illustrated example, the substrate 120 includes a ground plane 121, 124 on each side, as shown in FIGS. 1D and 1E respectively. In this example, the coupling paths 131, 132 are defined by a cut-out 133 in the ground plane 121, so that the coupling paths 131, 132 are connected to the ground plane 121 at one end, although this is not essential and alternatively other arrangements may be used. For example, the coupling paths do not need to be coupled to a ground plane, and alternatively open ended coupling paths could be used. A further alternative is that a ground plane may not be provided, in which case the coupling paths 131, 132 could be formed from metal tracks applied to the substrate 120. In this instance, the coupling paths 131, 132 can still be electrically coupled to ground, for example via vias or other connections provided on the substrate.

The input and output are provided in the form of conductive paths 141, 142 provided on an underside of the substrate 120, and these are typically defined by cut-outs 125, 126 in the ground plane 124. The input and output may in turn be coupled to additional connections depending on the intended application. For example, the input and output paths 141, 142 could be connected to edge-mount SMA coaxial connectors, direct coaxial cable connections, surface mount coaxial connections, chassis mounted coaxial connectors, or solder pads to allow the filter 100 to be directly soldered to another PCB, with the method chosen depending on the intended application. Alternatively the filter could be integrated into the PCB of other components of a communications system.

In the above example, the input and output paths 141, 142 are provided on an underside of the substrate. However, in this instance, the input and output paths 141, 142 are not enclosed by a ground plane. Accordingly, in an alternative example, a dual layered PCB can be used, with the input and output paths embedded as transmission lines inside the PCB, with the top and underside surfaces providing a continuous ground plane, as will be described in more detail below, with respect to the examples of FIGS. 5 to 8 and 12A to 12E. This has the virtue of providing full shielding of the inner parts of the filter, and also allows the filter to be mounted to a conducting or non-conducting surface, as convenient.

The input and output paths 141, 142 can be coupled to the coupling paths 131, 132 using any suitable technique, such as capacitive or inductive coupling, although in this example, this is achieved using respective electrical connections 122, 123, such as connecting vias, extending through the substrate 120. In this example, the input and output paths 141, 142 are electrically coupled to first ends of the coupling paths, with second ends of the coupling paths being electrically connected to ground.

In use, resonance modes of the resonator body provide respective energy paths between the input and output. Furthermore, the input coupling path and the output coupling path can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter, as will be described in more detail below. In this regard, the term "zero" refers to a transmission minimum in the frequency response of the filter, meaning transmission of signals at that frequency will be minimal, as will be understood by persons skilled in the art.

Figure 3A:
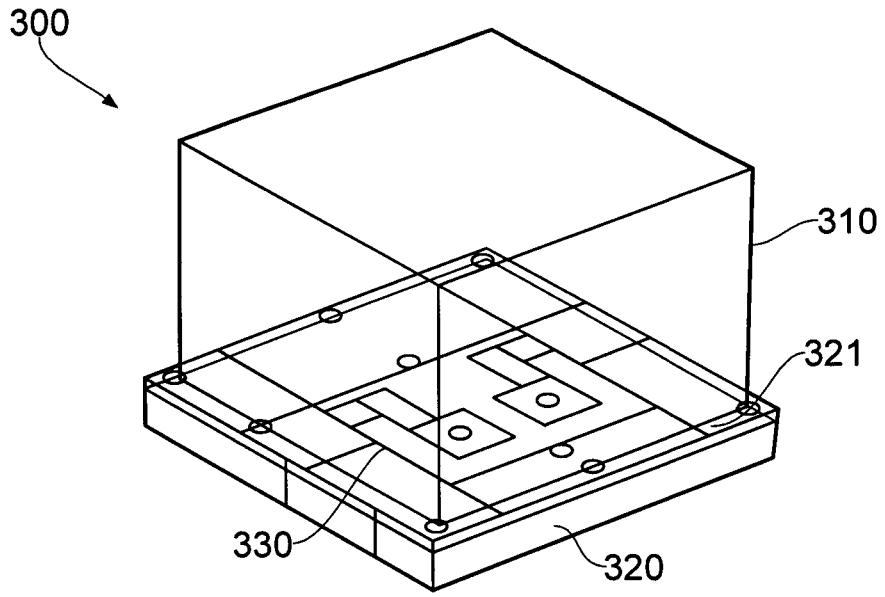
FIG. 3A is a schematic perspective view of an example of a specific configuration of a multi-mode filter.

A specific example filter is shown in FIG. 3A. In this example, the filter 300 includes a resonator body 310 made of 18 mm cubic ceramic body that has been silver coated on 5 sides, with the sixth side silvered in a thin band around the perimeter. The sixth side is soldered to a ground plane 321 on an upper side of a PCB 320, so that the coupling structure 330 is positioned against the un-silvered surface of the resonator body 310. Input and output lines on the PCB are implemented as coplanar transmission lines on an underside of the PCB 320 (not shown). It will therefore be appreciated that this arrangement is generally similar to that described above with respect to FIGS. 1A to 1E.

Figure 3B:
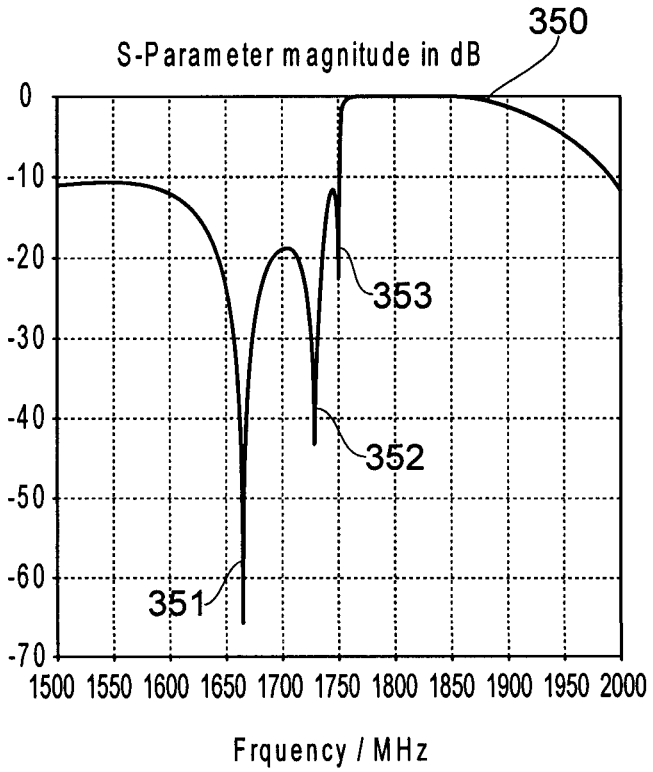
FIG. 3B is a graph of an example of the frequency response of the filter of FIG. 3A.

An example of a calculated frequency response for the filter is shown in FIG. 3B. As shown, the filter 100 can provide three low side zeros 351, 352, 353 adjacent to a sharp transition to a high frequency pass band 350. Alternatively, the filter 100 can provide three high side zeros adjacent to a sharp transition to a lower frequency pass band, described in more detail below with respect to FIG. 13B. When two filters are used in conjunction for transmission and reception, this allows transmit and receive frequencies to be filtered and thereby distinguished, as will be understood by persons skilled in the art.

Example coupling structures will now be described with reference to FIGS. 4A to 4F, together with an explanation of their ability to couple to different modes of a cubic resonator, thereby assisting in understanding the operation of the filter. It will be appreciated that the coupling structures may be formed in the substrate 120 or in a coating of the resonator body 110 as described above.

Traditional arrangements of coupling structures include a probe extending into the resonator body, as described for example in U.S. Pat. No. 6,853,271. In such arrangements, most of the coupling is capacitive, with some inductive coupling also present due to the changing currents flowing along the probe. If the probe is short, this effect will be small. Whilst such a probe can provide reasonably strong coupling, this tends to be with a single mode only, unless the shape of the resonant structure is modified. For a cubic resonator body, the coupling for each of the modes is typically as shown in Table 1 below.

TABLE 1

| Mode | H field coupling | E field coupling | Notes |
|---|---|---|---|
| TE 011 (E along X) | Negligible or zero due to tiny and orthogonal field. | Negligible or zero due to symmetry. | Negligible coupling |
| TE 101 (E along Y) | Negligible or zero due to tiny and orthogonal field. | Negligible or zero due to symmetry. | Negligible coupling |
| TM 110 (E along Z) | Some for long probe | strong | Strong coupling |

Furthermore, a probe has the disadvantage of requiring a hole to be bored into the cube.

Figure 4A:
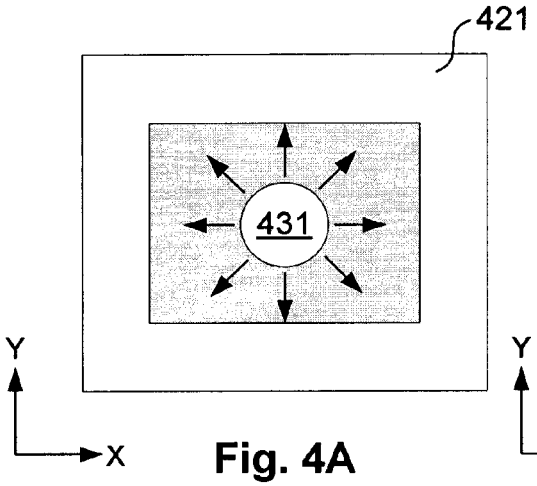
FIGS. 4A to 4F are schematic plan views of example coupling structures.

An easier to manufacture (and hence cheaper) alternative is to use a surface patch, as shown for example in FIG. 4A, in which a ground plane 421 is provided together with a coupling path 431. In this example, an electric field extending into the resonator body is generated by the patch, as shown by the arrows. The modes of coupling are as summarised in Table 2, and in general this succeeds in only weakly coupling with a single mode. Despite this, coupling into a single mode only can prove useful, for example if multiple coupling paths are to be provided on different surfaces to each couple only to a single respective mode. This could be used, for example, to allow multiple inputs and or outputs to be provided.

TABLE 2

| Mode | H field coupling | E field coupling | Notes |
|---|---|---|---|
| TE 011 (E along X) | none | Negligible or zero due to symmetry | Negligible coupling |
| TE 101 (E along Y) | none | Negligible or zero due to symmetry | Negligible coupling |
| TM 110 (E along Z) | none | Medium | Medium coupling |

Figure 4B:
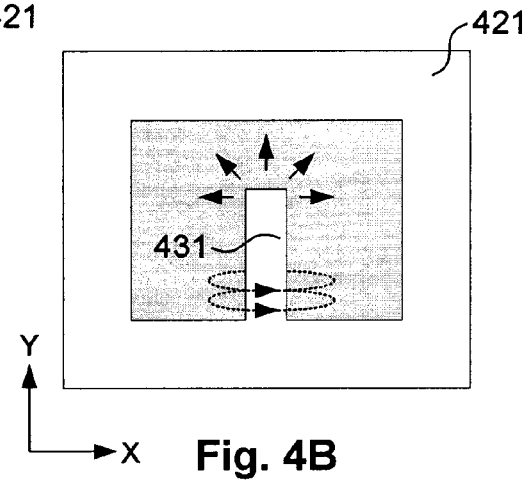

Coupling into two modes can be achieved using a quarter wave resonator, which includes a path extending along a surface of the resonator body, as shown for example in FIG. 4B. The electric and magnetic fields generated upon application of a signal to the coupling path are shown in solid and dotted lines respectively.

In this example, the coupling path 431 can achieve strong coupling due to the fact that a current antinode at the grounded end of the coupling path produces a strong magnetic field, which can be aligned to match those of at least two resonance modes of the resonator body. There is also a strong voltage antinode at the open circuited end of the coupling path, and this produces a strong electric field which couples to the TM110 mode, as summarised below in Table 3.

TABLE 3

| Mode | H field coupling | E field coupling | Notes |
|---|---|---|---|
| TE 011 (E along X) | Weak or zero | Weak or zero | Negligible coupling |
| TE 101 (E along Y) | strong | Weak or zero | Strong coupling |
| TM 110 (E along Z) | strong | medium | Strongest coupling |

Figure 4C:
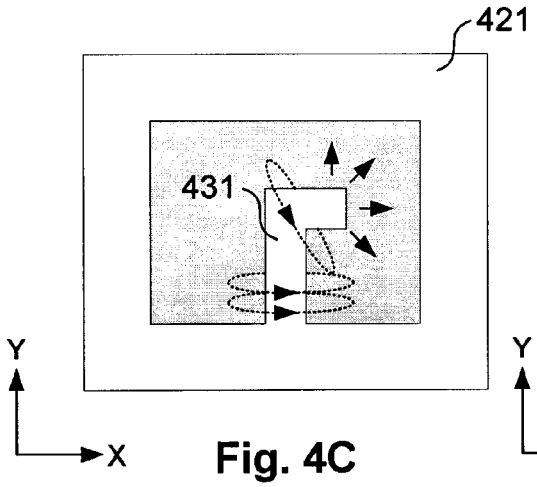

In the example of FIG. 4C, the coupling path 431 includes an angled path, meaning a magnetic field is generated at different angles. However, in this arrangement, coupling to both of the TE modes as well as the TM mode still does not occur as eigenmodes of the combined system of resonator body and input coupling path rearrange to minimise the coupling to one of the three eigenmodes.

Figure 4D:
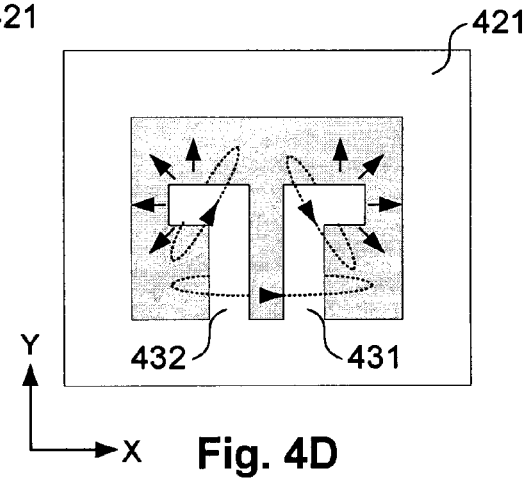

To overcome this, a second coupling path 432 can be introduced in addition to the first coupling path 431, as shown for example in FIG. 4D. This arrangement avoids minimisation of the coupling and therefore provides strong coupling to each of the three resonance modes. The arrangement not only provides coupling to all three resonance modes for both input and output coupling paths, but also allows the coupling strengths to be controlled, and provides further input to output coupling.

In this regard, the coupling between the input and output coupling paths 431, 432 will be partially magnetic and partially electric. These two contributions are opposed in phase, so by altering the relative amounts of magnetic and electric coupling it is possible to vary not just the strength of the coupling but also its polarity.

Figure 4E:
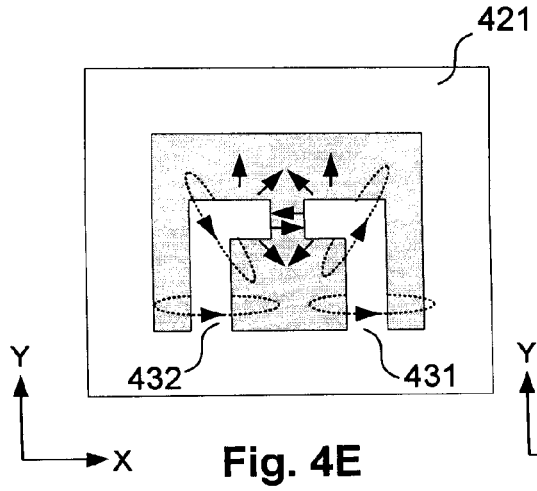

Thus, in the example of FIG. 4D, the grounded ends of the coupling paths 431, 432 are close whilst the coupling path tips are distant. Consequently, the coupling will be mainly magnetic and hence positive, so that a filter response including zeros at a higher frequency than a pass band is implemented, as will be described in more detail below with respect to the receive band in FIG. 13B. In contrast, if the tips of the coupling paths 431, 432 are close and the grounded ends distant, as shown in FIG. 4E, the coupling will be predominantly electric, which will be negative, thereby allowing a filter with zeros at a lower frequency to a pass band to be implemented, similar to that shown at 350, 351, 352, 353 in FIG. 3B.

Figure 4F:
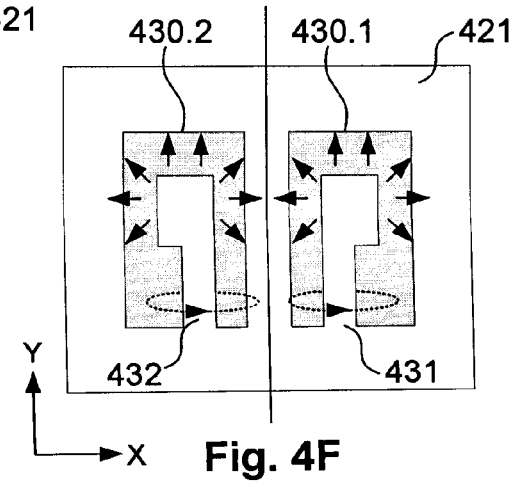

In the example of FIG. 4F, two coupling structures 430.1, 430.2 are provided on a ground plane 421, each coupling structure defining 430.1, 430.2 a respective coupling path 431, 432. The coupling paths are similar to those described above and will not therefore be described in further detail. The provision of multiple coupling structures allows a large variety of arrangements to be provided. For example, the coupling structures can be provided on different surfaces, of the resonator body, as shown by the dotted line. This could be performed by using a shaped substrate, or by providing separate substrates for each coupling structure. This also allows for multiple inputs and/or outputs to be provided.

It will be clear from FIGS. 4A to 4F and their description above that many different coupling structures may be formed according to embodiments of the present invention, and in particular the coupling path(s) of those coupling structures can have different portions for primarily coupling to different resonant modes of the resonant body 110. The coupling may be to the H-field (that is, magnetic) and/or the E-field (that is, electric) of the respective resonant mode.

Figure 5:
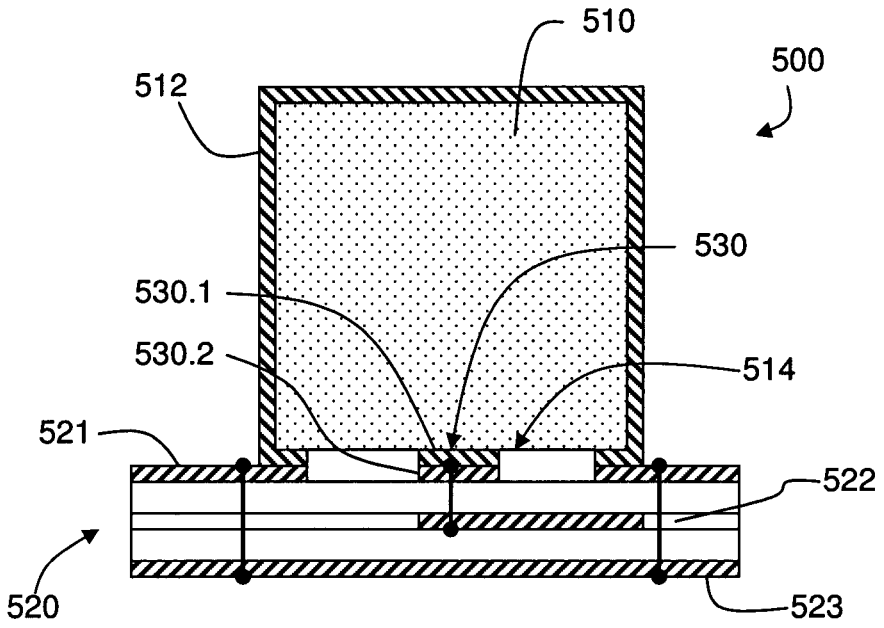
FIG. 5 is a side elevation of a filter according to an embodiment of the invention showing the connection between a resonator body and a printed circuit board substrate.

FIG. 5 shows a side view cross-section of a filter 500 according to embodiments of the present invention. The filter 500 comprises a resonator body 510 substantially as described above, having a piece of material having a high dielectric constant and which is capable of supporting multiple resonant modes. In the illustrated embodiment the piece of material is cuboid, but it could take any other shape as required by the filter design. The resonator body 510 is covered in a layer 512 of conductive material (e.g. a metal such as silver, gold or copper), which in one embodiment surrounds the resonator body, providing a continuous conductive surface around the dielectric material, with the exception of an aperture 514 which allows signals to be input to and/or output from the resonator body 510. Where the resonator body 510 comprises a flat (i.e. planar) surface, the aperture 514 can be arranged on the flat surface. The aperture 514 may cover the majority of the flat surface. In the illustrated embodiment, therefore, the conductive layer 512 covers all faces of the cuboid resonator body 510 with the exception of the face which is in contact with a substrate 520.

A coupling structure 530 is located within the aperture 514, and is arranged to input signals to and/or output signals from the resonator body 510. The coupling structure 530 may take any of the forms described herein, including those described with respect to FIGS. 1D, 3A, 4A to 4F, 10A to 10C, 11A to 11E, 12B or 14B. In the illustrated embodiment, the coupling structure 530 comprises a conductive track 530.1 (of which only a cross section is visible in FIG. 5) formed on the surface of the resonator body 510. A connection pad 530.2 on the surface of the substrate connects the conductive track 530.1 to an input and/or output as necessary, as will be described below. Of course, it will be clear from the discussion above that the conductive track 530.1 might alternatively, or additionally, be arranged on the surface of the substrate 520. In that case, the resonator body 510 may be arranged lower than illustrated in order to bring the dielectric material and the coupling structure 530 (or more particularly the conductive track 530.1) into close proximity or even into contact with each other.

The resonator body 510 is arranged on a substrate 520, which in the illustrated embodiment is a printed circuit board (PCB) having a plurality of layers. In FIG. 5, the PCB 520 has three layers, but alternative embodiments will be shown in which the PCB has two layers, and it will be clear to those skilled in the art that more than three layers may be provided without affecting operation of the filter 500 and without departing from the scope of the invention. Note that the phrase "number of layers" as used herein refers to the number of conductive layers as is the convention in the art. Each conductive layer is separated by a non-conductive layer of, for example, a material having low dielectric constant.

An uppermost layer (i.e. one of the outermost layers) of the PCB substrate 520 comprises a ground plane 521 having an aperture through which signals can be transferred to and/or from the resonator body 510. In the illustrated embodiment, the aperture in the substrate ground plane 521 substantially corresponds in size and shape to the aperture 514 in the conductive layer 512 covering the resonator body 510. In other embodiments, the aperture in the substrate ground plane 521 may correspond in shape to the aperture 514 in the conductive layer 512, but have a greater or smaller size. The connection pad 530.2 (or, in alternative embodiments, the coupling structure 530 itself) is arranged within the aperture. This is electrically coupled to an inner signal layer 522 through which signals can be passed to and/or from the resonator body 510, for example using a standard via or plated through-hole, as will be familiar to those skilled in the art.

A final, outermost layer 523 comprises a further ground plane, which is arranged so as to cover the aperture 514 as will be described in further detail.

The conductive layer 512 covering the resonator body 510 is electrically connected to the upper ground plane 521. Solder is suitable for this task as it provides both electrical and mechanical connection, but any other suitable connection mechanism may be employed. The upper ground plane 521 is further electrically coupled to the lower ground plane 523, which extends over the aperture 514 (albeit at a position removed from the aperture itself). In this manner, a near continuous ground plane is established around the resonator body 510, and energy leakage from the filter 500 is reduced or minimized. The conductive layer 512 surrounding the resonator body 510 prevents energy from radiating out of the dielectric material from surfaces on which the conductive layer 512 is present. The electrical coupling between the upper and lower ground planes 521, 523 prevents energy from leaking out of the aperture 514, except of course the controlled extraction of energy by the coupling structure 530 corresponding to output signals.

The manner of the electrical coupling between the upper and lower ground planes 521, 523 may vary according to the frequencies of the input and output signals. That is, in one embodiment the upper and lower ground planes 521, 523 are coupled to each other by one or more electrical connections such as vias or plated through holes, as will be familiar to those skilled in the art. The electrical connections may be distributed so as to largely correspond with the boundary of the aperture 514. However, the number of such electrical connections, as well as their precise positioning, may be altered according to the frequencies of the signals which will be input to and/or output from the resonator body 510. If sufficient connections are used, based upon the frequencies present in the circuit, then the lower ground plane 523 forms the final (i.e. $6^{th}$ in the illustrated embodiment) conductive side to the resonator 'box'. This grounded, conductive, side acts as a reflector, in the same manner as the metallised sides of the resonator body 510. The electromagnetic energy is therefore kept within the structure and prevented from radiating outwards.

Figure 6:
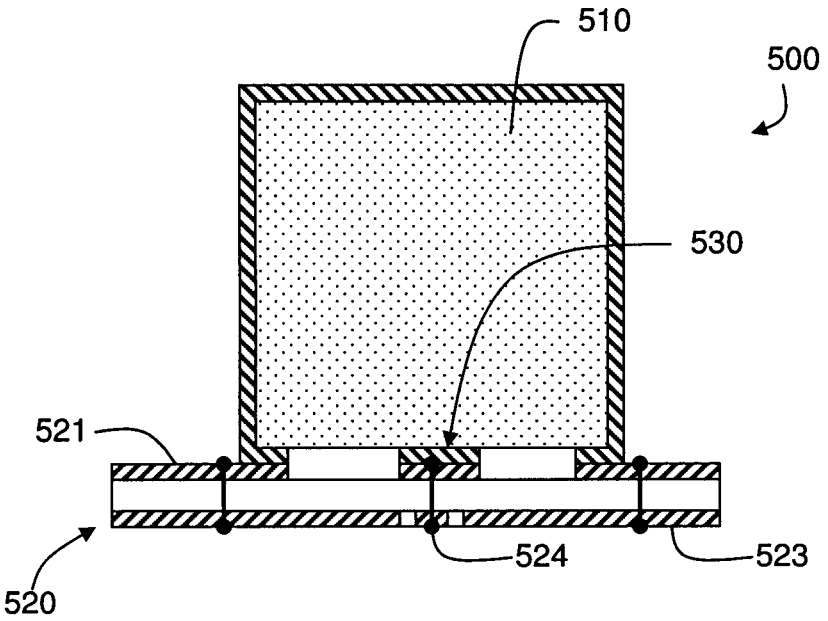
FIG. 6 is a side elevation of a filter according to a further embodiment of the invention showing the connection between a resonator body and a printed circuit board substrate.

FIG. 6 shows a filter 500 according to another embodiment of the present invention, in which the resonator body 510 is mounted on a two-layer PCB 520. Like components are provided with like reference numerals and thus will not be described further herein.

In this embodiment, the upper and lower ground planes 521, 523 of the PCB 520 are again electrically coupled to prevent energy from being radiated out of the filter 500 through the aperture 514. The difference with the embodiment of FIG. 5 is that the coupling structure 530 is coupled not to a signal layer lying within the PCB 520, but to a connection pad 524 arranged within the lower ground plane 523. Thus, the lower ground plane 523 is broken in at least one place by a connecting pad or via. In one embodiment (not illustrated), the lower ground plane 523 is broken in at least two places with at least two connection pads or vias: one for an input connection and one for an output connection. Although the lower ground plane 523 is broken in order to allow signals to be passed through, the plane is still sufficient to reflect substantially all of the RF energy back into the resonator body 510 and therefore to reduce or minimize energy leakage.

As will be described below, the connection pad 524 can then be connected to a similar pad on the top layer of a further PCB (e.g. corresponding to a PCB of a user) using, for example, flow-soldering techniques. From there, a connection can be made to a signal layer of that further PCB as desired.

Figure 7:
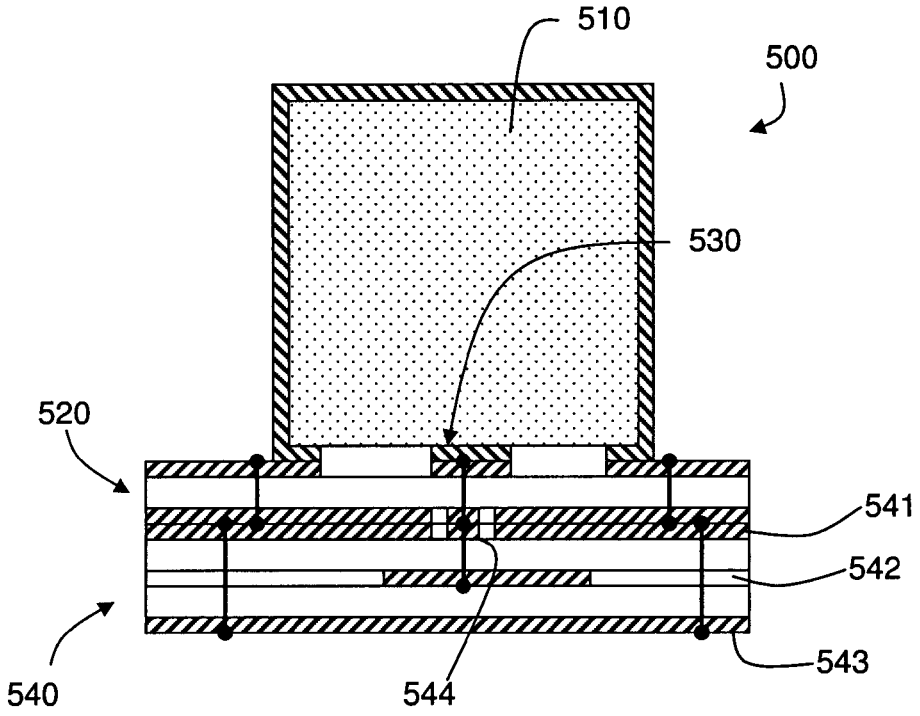
FIG. 7 is a side elevation of a filter according to an embodiment of the invention showing the connection between a resonator body, a printed circuit board substrate and a further printed circuit board.

FIG. 7 shows a filter according to another embodiment of the invention in which such a connection has taken place. The filter 500 therefore comprises a second PCB structure 540 electrically coupled to the first PCB 520. Such an arrangement allows the filter 500 to be provided to a consumer with a PCB substrate which can readily be coupled to the consumer's pre-existing PCB structures.

The second PCB 540 comprises an upper ground plane layer 541, an inner signal layer 542 and a lower ground plane layer 543. The upper ground plane layer 541 comprises a connection pad 544 electrically coupled to the connection pad 524 of the first PCB 520, and this is connected to the inner signal layer 542 by, for example, a via. Thus the coupling structure 530 is effectively coupled to an input and/or an output.

The upper ground plane layer 541 of the second PCB 540 is electrically and mechanically coupled (for example using solder) to the lower ground plane layer 523 of the first PCB 520. The upper ground plane layer 541 of the second PCB 540 is then electrically coupled to the lower ground plane layer 543 via one or more electrical connections.

The filter shown in FIG. 7 thus comprises three ground plane layers: a first, upper ground plane layer 521 to which the conductive layer 512 is connected; a second, middle ground-plane layer (formed by a combination of layers 523 and 541) which forms part of the grounded conductive box surrounding resonator body 510 and reducing energy leakage, through which the input and/or output signals pass using 'vias' or similar; and a third, lower ground-plane layer 543 which is the ground plane for the PCB track and does not (electrically) form a part of the grounded conductive "box" preventing energy leakage from the resonator body 510.

The holes in the middle ground plane layer through which the input and/or output signals pass are small and consequently the integrity of this ground plane layer is very good.

Figure 8:
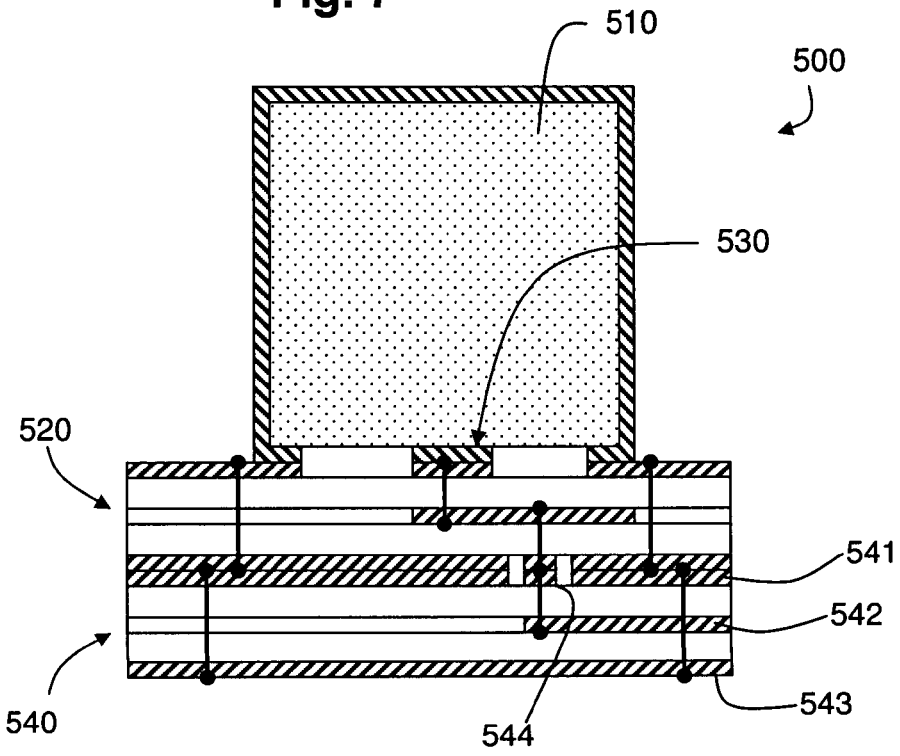
FIG. 8 is a side elevation of a filter according to a further embodiment of the invention showing the connection between a resonator body, a printed circuit board substrate and a further printed circuit board.

FIG. 8 shows a further filter 500 according to embodiments of the present invention, in which the PCB substrate 520 comprises three layers as shown in FIG. 5. The coupling structure 530 is coupled to an inner signal layer 522 in the first PCB 520, which in turn is coupled to a connection pad 524 in the lower ground plane layer 523 of the first PCB. This is connected to a corresponding connection pad 544 in the upper ground plane layer 541 of the second PCB, which in turn is connected to an inner signal layer 542 of the second PCB 540. All connections between layers can be, for example, by a via or another suitable mechanism. Of course, it will be apparent to those skilled in the art that further PCBs could be connected to the second PCB 540 without departing from the scope of the invention. Further, an increased number of layers could be included in any of the PCBs to accommodate, for example, a power plane or further signal layers.

Embodiments of the present invention therefore provide a mechanism for electrically coupling signals to and/or from a dielectric resonator of a multi-mode filter, while reducing or minimizing energy leakage from the resonator through use of a PCB ground plane to reflect energy back into the resonator.

Figure 9:
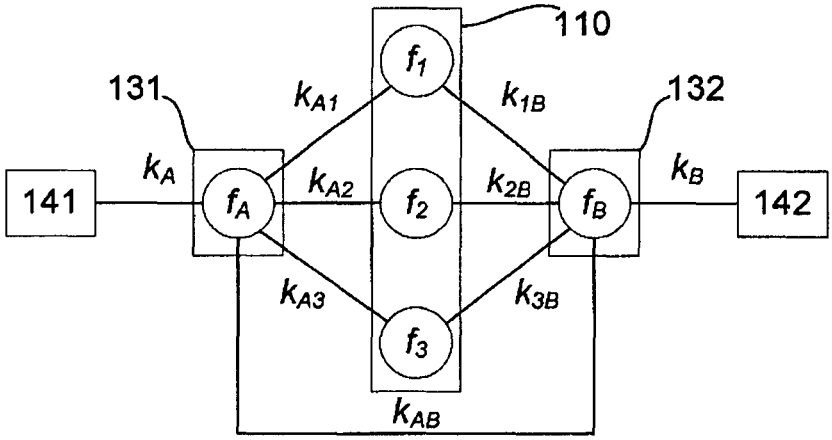
FIG. 9 is a schematic diagram of an example of a filter network model for the filter of FIGS. 1A to 1E.

In practice, the filter described in FIGS. 1A to 1E can be modelled as two low Q resonators, representing the input and output coupling paths 131, 132 coupled to three high Q resonators, representing the resonance modes of the resonator body 110, and with the two low Q resonators also being coupled to each other. An example filter network model is shown in FIG. 9.

In this example, the input and output coupling paths 131, 132 have respective resonant frequencies $f_A$, $f_B$, whilst the resonance modes of the resonator body 110 have respective resonant frequencies $f_1$, $f_2$, $f_3$. The degree of coupling between an input 141 and output 142 and the respective input and output coupling paths 131, 132 is represented by the coupling constants $k_A$, $k_B$. The coupling between the coupling paths 131, 132 and the resonance modes of the resonator body 110 are represented by the coupling constants $k_{A1}$, $k_{A2}$, $k_{A3}$, and $k_{1B}$, $k_{2B}$, $k_{3B}$, respectively, whilst coupling between the input and output coupling paths 131, 132 is given by the coupling constant $k_{AB}$.

It will therefore be appreciated that the filtering response of the filter can be controlled by controlling the coupling constants and resonance frequencies of the coupling paths 131, 132 and the resonator body 110.

In one example, a desired frequency response is obtained by configuring the resonator body 110 so that $f_1<f_2<f_3$ and the coupling paths 131, 132 so that $f_1<f_A$, $f_B<f_3$. This places the first coupling path $f_1$ close to the desired sharp transition at the band edge, as shown for example at 353, 363 in FIG. 3B. The coupling constants $k_{A1}$, $k_{A3}$, $k_{1B}$, $k_{2B}$, $k_{3B}$, are selected to be positive, whilst the constant $k_{A2}$ is negative. If the zeros are to be on the low frequency side of the pass band, as shown for example at 351, 352, 353 and as will be described in more detail below with respect to the transmit band in FIG. 13B, the coupling constant $k_{AB}$ should be negative, while if the zeros are to be on the high frequency side as will be described in more detail below with respect to the receive band in FIG. 13B, the coupling constant $k_{AB}$ should be positive. The coupling constants $k_{AB}$, $k_{A1}$ generally have similar magnitudes, although this is not essential, for example if a different frequency response is desired.

Figure 10A:
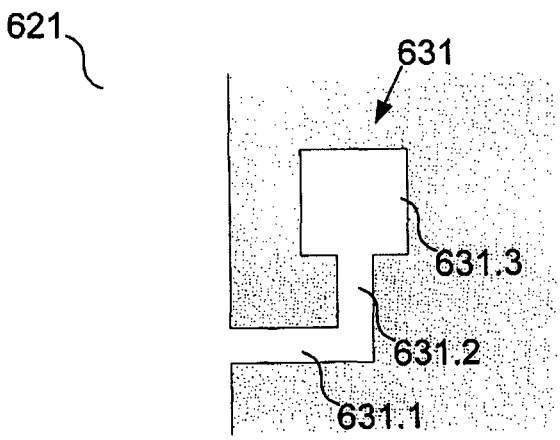
FIGS. 10A to 10C are schematic plan views of example resonators illustrating how resonator configuration impacts on coupling constants of the filter.
Figure 10B:
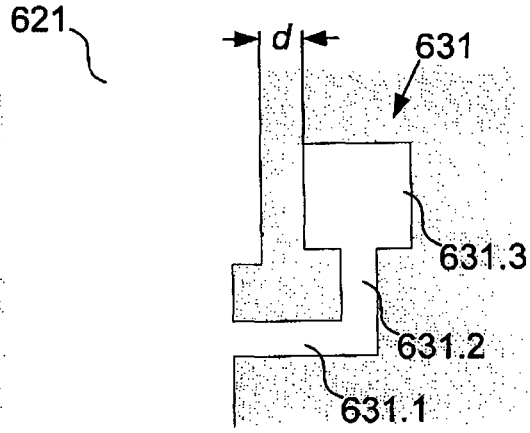
Figure 10C:
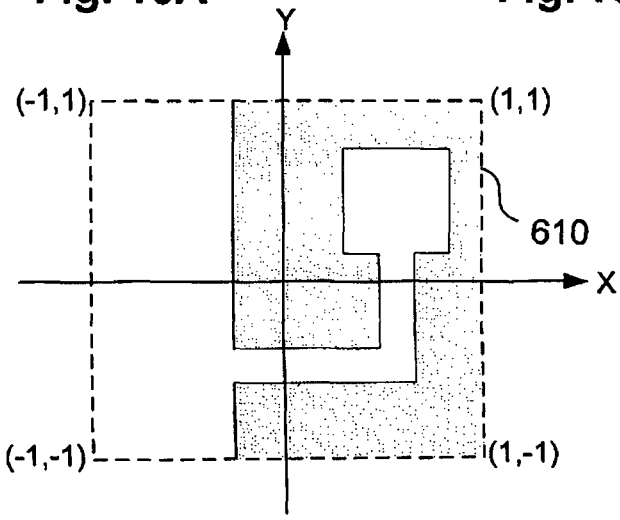

The strength of the coupling constants can be adjusted by varying the shape and position of the input and output coupling paths 131, 132, as will now be described in more detail with reference to FIGS. 10A to 10C.

For the purpose of this example, a single coupling path 631 is shown coupled to a ground plane 621. The coupling path 631 is of a similar form to the coupling path 131 and therefore includes a first path 631.1 extending perpendicularly away from the ground plane 621, a second path 631.2 extending in a direction orthogonal to the first path 631.1 and terminating in a conductive resonator patch 631.3. In use, the first and second paths 631.1, 631.2 are typically arranged parallel to the axes of the resonator body, as shown by the axes X, Y, with the coordinates of FIG. 10C representing the locations of the coupling paths relative to a resonator body shown by the dotted lines 610, extending from (−1,−1) to (1,1). This is for the purpose of example only, and is not intended to correspond to the positioning of the resonator body in the examples outlined above. To highlight the impact of the configuration of the coupling path 631 on the degrees of coupling reference is also made to the distance d shown in FIG. 10B, which represents the proximity of patch 631.3 to the ground plane 621.

In this example, the first path 631.1 is provided adjacent to the grounded end of the coupling path 631 and therefore predominantly generates a magnetic field as it is near a current anti-node. The second path 631.2 has a lower current and some voltage and so will generate both magnetic and electric fields. Finally the patch 631.3 is provided at an open end of the coupling path and therefore predominantly generates an electric field since it is near the voltage anti-node.

In use, coupling between the coupling path 631 and the resonator body can be controlled by varying coupling path parameters, such as the lengths and widths of the coupling paths 631.1, 631.2, the area of the resonator patch 631.3, as well as the distance d between the resonator patch 631.3 and the ground plane 621. In this regard, as the distance d decreases, the electric field is concentrated near the perimeter of the resonator body, rather than up into the bulk of the resonator body, so this decreases the electric coupling to the resonance modes.

Referring to the field directions of the three cavity modes shown in FIGS. 2A to 2C, the effect of varying the coupling path parameters is as summarised in Table 4 below. It will also be appreciated however that varying the coupling path width and length will affect the impedance of the path and hence the frequency response of the coupling path 631. Accordingly, these effects are general trends which act as a guide during the design process, and in practice multiple changes in coupling path resonant frequencies and the degree of coupling occur for each change in coupling structure and resonator body geometry. Consequently, when designing a coupling structure geometry it is typical to perform simulations of the 3D structure to optimise the design.

TABLE 4

| Mode | Coupling Strength to Quarter Wave Resonator |
|---|---|
| TE 011 (E along X) | Maximum coupling when the first path 631.1 is long and at y = 0.<br>Negligible coupling from the second path 631.2.<br>Negligible coupling from the patch 631.3 when positioned at x = 0, y = 0. |
| TE 101 (E along Y) | Negligible coupling from the first path 631.1.<br>Maximum coupling when the second path 631.2 is long and at x = 0.<br>Negligible coupling from the patch 631.3 when positioned at x = 0, y = 0. |
| TM 110 (E along Z) | Maximum coupling when the first path 631.1 is long and at x = −1, y = 0.<br>Maximum coupling when the second path 631.2 is long and at x = 0, y = +1 or −1.<br>Maximum coupling when the patch 631.3 is large and at x = 0, y = 0.<br>Decreased coupling when the distance d is small. |

It will be appreciated from the above that a range of different coupling structure configurations can be used, and examples of these are shown in FIGS. 11A to 11E. In these examples, reference numerals similar to those used in FIG. 1D are used to denote similar features, albeit increased by 600.

Thus, in each example, the arrangement includes a resonator body 710 mounted on a substrate 720, having a ground plane 721. A coupling structure 730 is provided by a cut-out 733 in the ground plane 721, with the coupling structure including two coupling paths 731, 732, representing input and output coupling paths respectively. In this example, vias 722, 723 act as connections to an input and output respectively (not shown in these examples). Again, however, the coupling structures may be formed in the conductive coating of the resonant body 710 rather than, or in addition to, on the substrate 720.

Figure 11A:
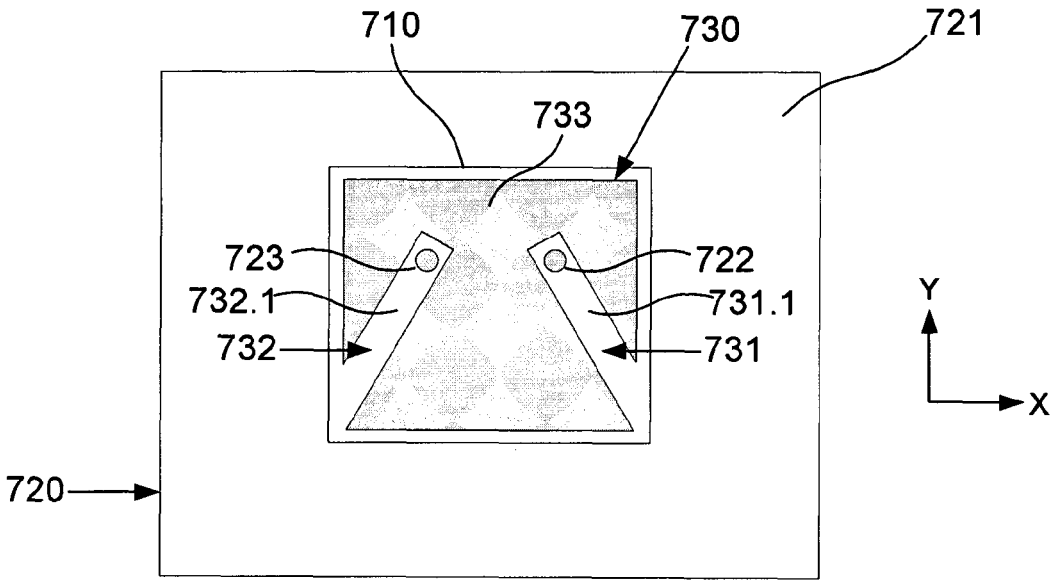
FIGS. 11A to 11E are schematic plan views of example of alternative coupling structures for the filter of FIGS. 1A to 1E.

In the example of FIG. 11A, the input and output coupling paths 731, 732 include a single straight coupling path 731.1, 732.1 extending from the ground plane 721 at an angle relative to the X, Y axes. Thus the coupling paths have a component (i.e. a Cartesian component) in a direction parallel to the X axis and a component in a direction parallel to the Y axis. This generates a magnetic field at the end of the path near the ground plane, with this providing coupling to each of the TE fields simultaneously.

Figure 11B:
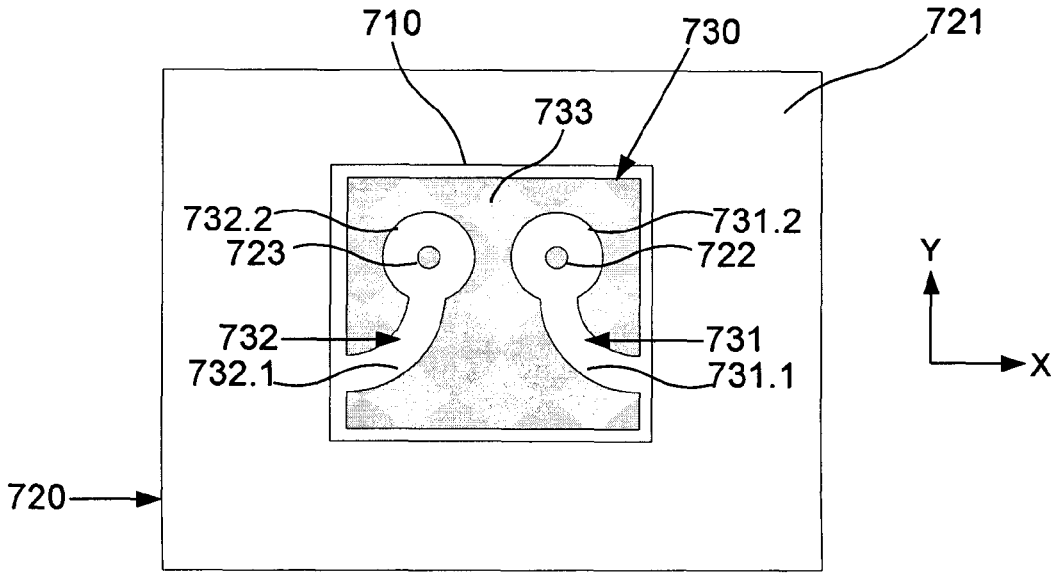

In the example of FIG. 11B, the input and output coupling paths 731, 732 include a single curved coupling path 731.1, 732.1 extending from the ground plane 721, to a respective resonator patch 731.2, 732.2. As shown the path extends a distance along each of the X, Y axes, so that magnetic fields generated along the path couple to each of the TE and TM modes, whilst the patch predominantly couples to the TM mode. It will be noted that in this example the patch 731.2, 732.3 has a generally circular shape, highlighting that different shapes of patch can be used.

Figure 11C:
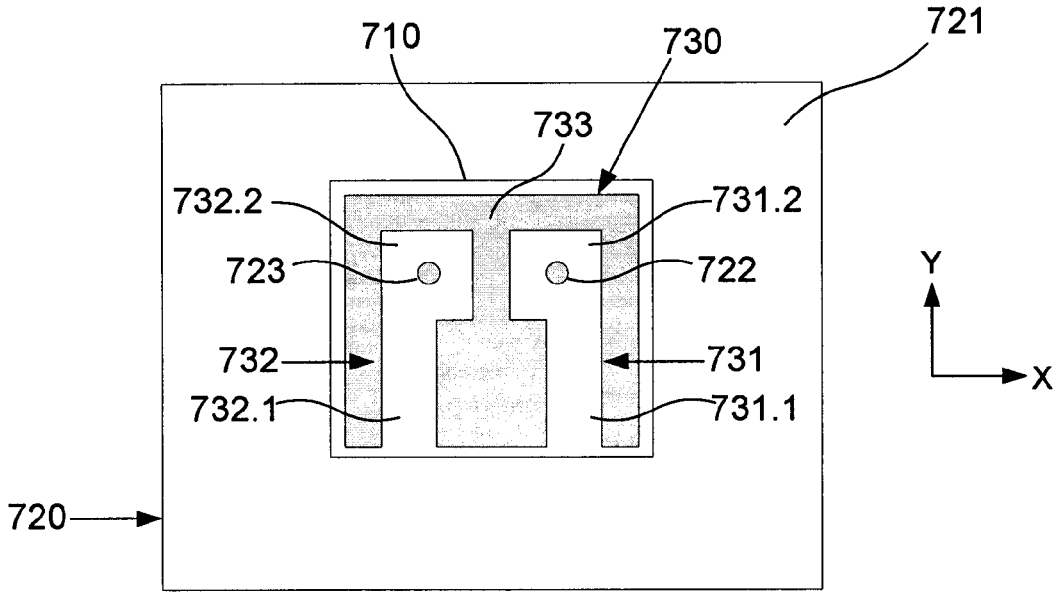
Figure 11D:
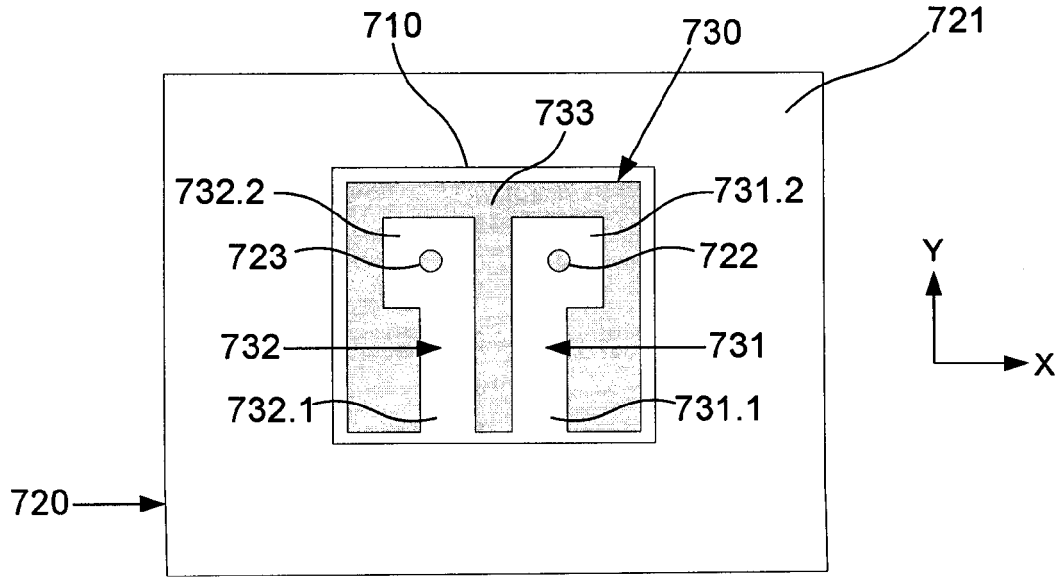

In the examples of FIGS. 11C and 11D, the input and output coupling paths 731, 732 include a single coupling path 731.1, 732.1 extending from the ground plane 721 to a patch 731.2, 732.2, in a direction parallel to an X-axis. The paths 731.1, 732.1 generate a magnetic field that couples to the TE101 and TM modes, whilst the patch predominantly couples to the TM mode.

In the example of FIG. 11D the grounded ends of the coupling paths 731.1, 732.1 are close whilst the coupling path tips are distant. Consequently, the coupling will be mainly magnetic and so the coupling will be positive, thereby allowing a filter having high frequency zeros to be implemented. In contrast, if the tips of the coupling paths 731.1, 732.1 are close and the grounded ends distant, as shown in FIG. 11C, the coupling will be predominantly electric, which will be negative and thereby allow a filter with low frequency zeros to be implemented.

Figure 11E:
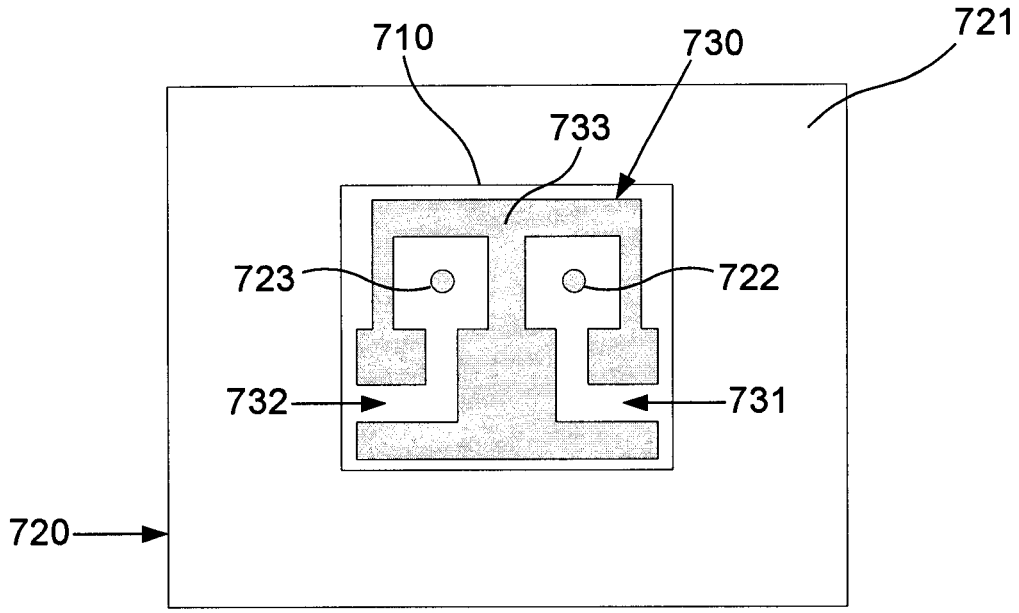

In the arrangement of FIG. 11E, this shows a modified version of the coupling structure of FIG. 1D, in which the cut-out 733 is modified so that the patch 731.3, 732.3 is nearer the ground plane, thereby decreasing coupling to the TM field, as discussed above.

In some scenarios, a single resonator body cannot provide adequate performance (for example, attenuation of out of band signals). In this instance, filter performance can be improved by providing two or more resonator bodies arranged in series, to thereby implement a higher-performance filter.

In one example, this can be achieved by providing two resonator bodies in contact with each other, with one or more apertures provided in the silver coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single coupling path, with a coupling path on one resonator body acting as an input and the coupling path on the other resonator body acting as an output. Alternatively, the input of a downstream filter can be coupled to the output of an upstream filter using a suitable connection such as a short transmission line. An example of such an arrangement will now be described with reference to FIGS. 12A to 12E.

In this example, the filter includes first and second resonator bodies 810A, 810B mounted on a common substrate 820. The substrate 820 is a multi-layer substrate providing external surfaces 821, 825 defining a common ground plane, and an internal surface 824.

In this example, each resonator body 810A, 810B is associated with a respective coupling structure 830A, 830B provided by a corresponding cut-out 833A, 833B in the ground plane 821. The coupling structures 830A, 830B include respective input and output coupling paths 831A, 832A, 831B, 832B, which are similar in form to those described above with respect to FIG. 1D, and will not therefore be described in any detail. Connections 822A, 823A, 822B, 823B couple the coupling paths 831A, 832A, 831B, 832B to paths on the internal layer 824. In this regard, an input 841 is coupled via the connection 822A to the coupling path 831A. A connecting path 843 interconnects the coupling paths 832A, 831B, via connections 823A, 822B, with the coupling path 823B being coupled to an output 842, via connection 823B.

It will therefore be appreciated that in this example, signals supplied via the input 841 are filtered by the first and second resonator bodies 810A, 810B, before in turn being supplied to the output 842.

Figure 12A:
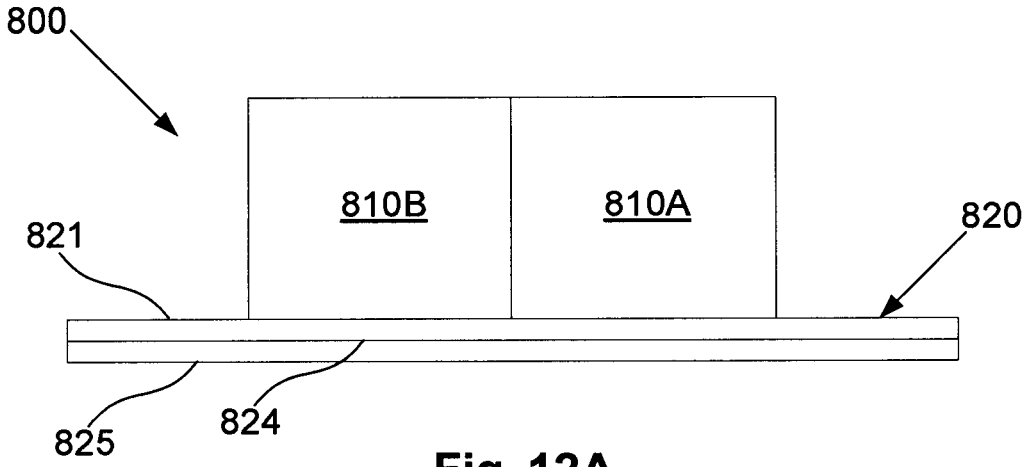
FIG. 12A is a schematic side view of an example of a multi-mode filter using multiple resonator bodies.
Figure 12B:
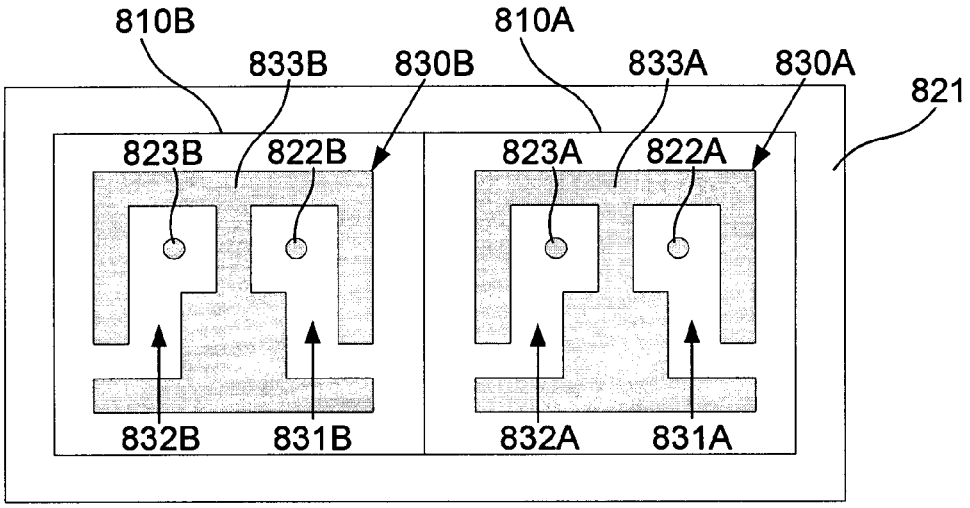
FIG. 12B is a schematic plan view of an example of the substrate of FIG. 12A including multiple coupling structures.
Figure 12C:
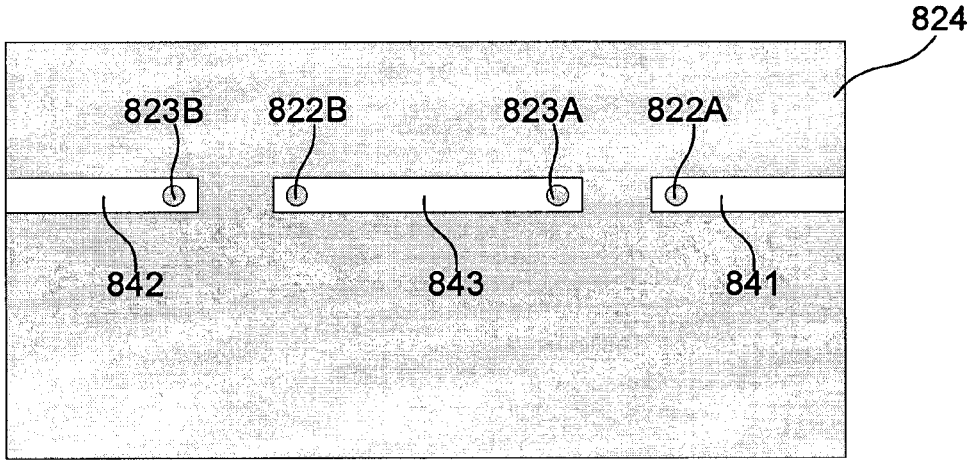
FIG. 12C is a schematic internal view of an example of the substrate of FIG. 12A including inputs and outputs.
Figure 12D:
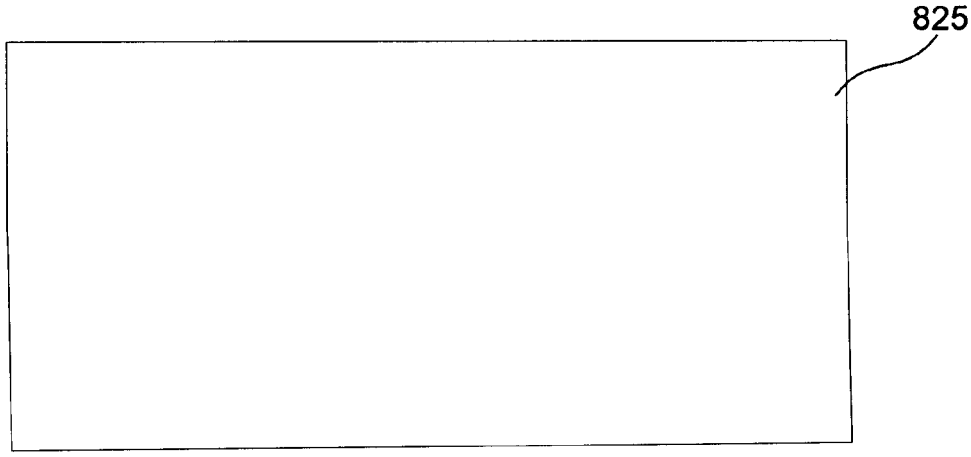
FIG. 12D is a schematic underside view of an example of the substrate of FIG. 12A.
Figure 12E:
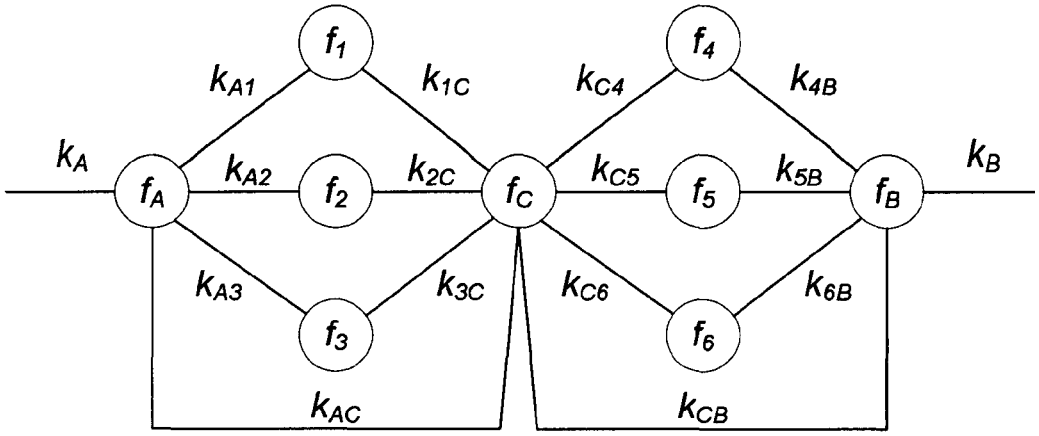
FIG. 12E is a schematic diagram of an example of a filter network model for the filter of FIGS. 12A to 12D.

In this arrangement, the connecting path 843 acts like a resonator, which distorts the response of the filters so that the cascade response cannot be predicted by simply multiplying the responses of the two cascaded filters. Instead, the resonance in the transmission line must be explicitly included in a model of the whole two cube filter. For example, the transmission line could be modelled as a single low Q resonator having frequency $f_C$, as shown in FIG. 12E.

Figure 13A:
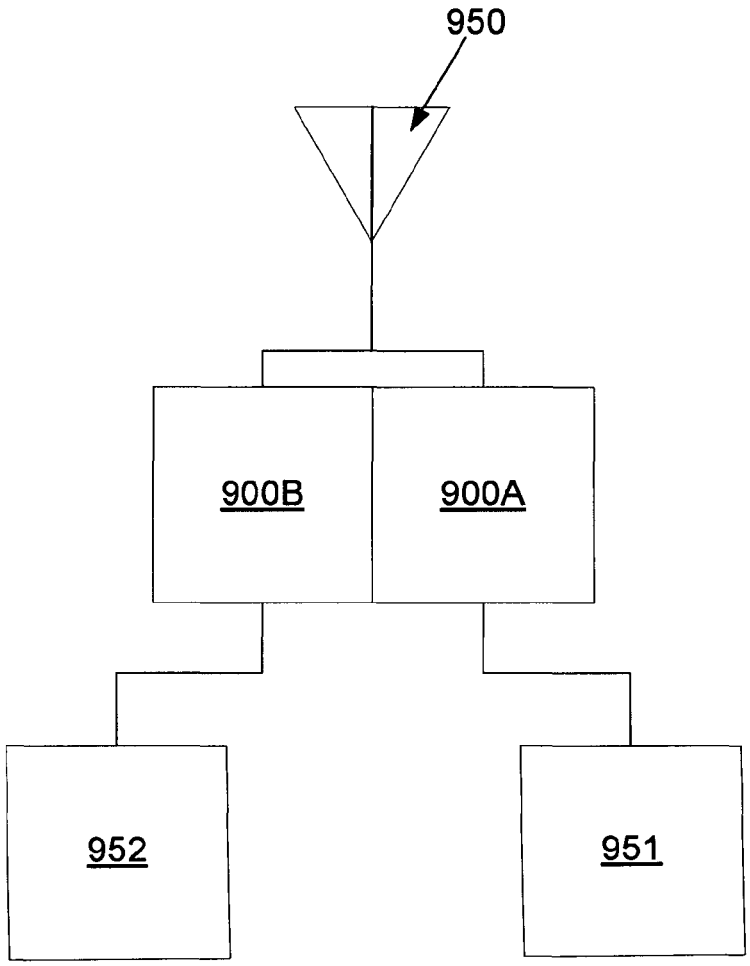
FIG. 13A is a schematic diagram of an example of a duplex communications system incorporating a multi-mode filter.

A common application for filtering devices is to connect a transmitter and a receiver to a common antenna, and an example of this will now be described with reference to FIG. 13A. In this example, a transmitter 951 is coupled via a filter 900A to the antenna 950, which is further connected via a second filter 900B to a receiver 952.

In use, the arrangement allows transmit power to pass from the transmitter 951 to the antenna with minimal loss and to prevent the power from passing to the receiver. Additionally, the received signal passes from the antenna to the receiver with minimal loss.

Figure 13B:
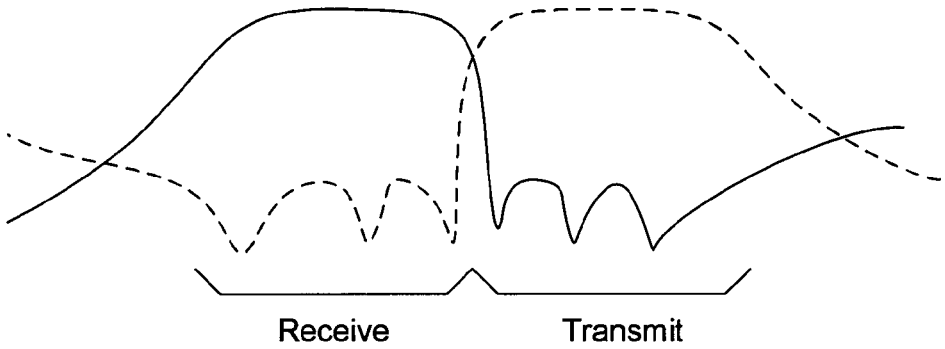
FIG. 13B is a schematic diagram of an example of the frequency response of the multi-mode filter of FIG. 13A.

An example of the frequency response of the filter is as shown in FIG. 13B. In this example, the receive band (solid line) is at lower frequencies, with zeros adjacent the receive band on the high frequency side, whilst the transmit band (dotted line) is on the high frequency side, with zeros on the lower frequency side, to provide a high attenuation region coincident with the receive band. It will be appreciated from this that minimal signal will be passed between bands. It will be appreciated that other arrangements could be used, such as to have a receive pass band at a higher frequency than the transmit pass band.

Figure 13C:
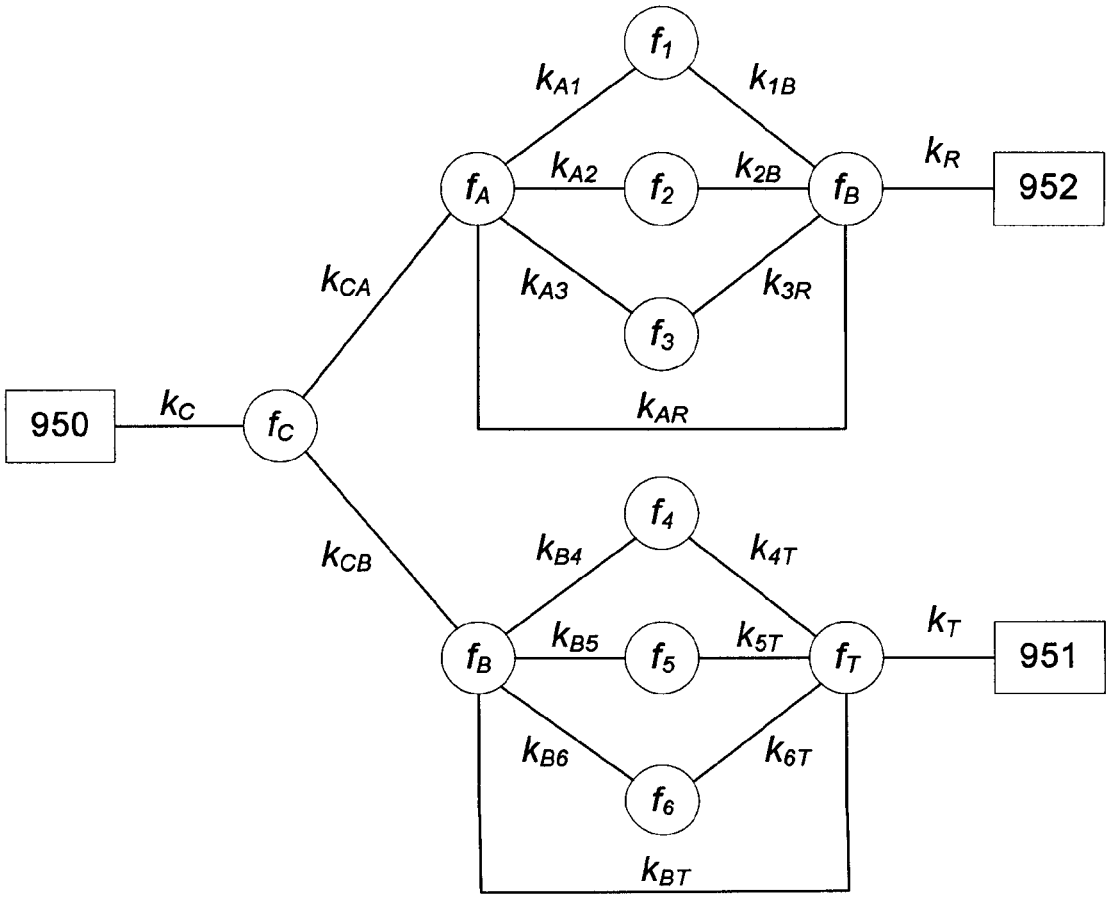
FIG. 13C is a schematic diagram of an example of a filter network model for the filter of FIG. 13A.

The duplexed filter can be modelled in a similar way to the single cube and cascaded filters, with an example model for a duplexer using single resonator body transmit and receive filters being shown in FIG. 13C. In this example, the transmit and receive filters 900A, 900B are coupled to the antenna via respective transmission lines, which in turn provide additional coupling represented by a further resonator having a frequency $f_C$, and coupling constants $k_C$, $k_{CA}$, $k_{CB}$, determined by the properties of the transmission lines.

Figure 14C:
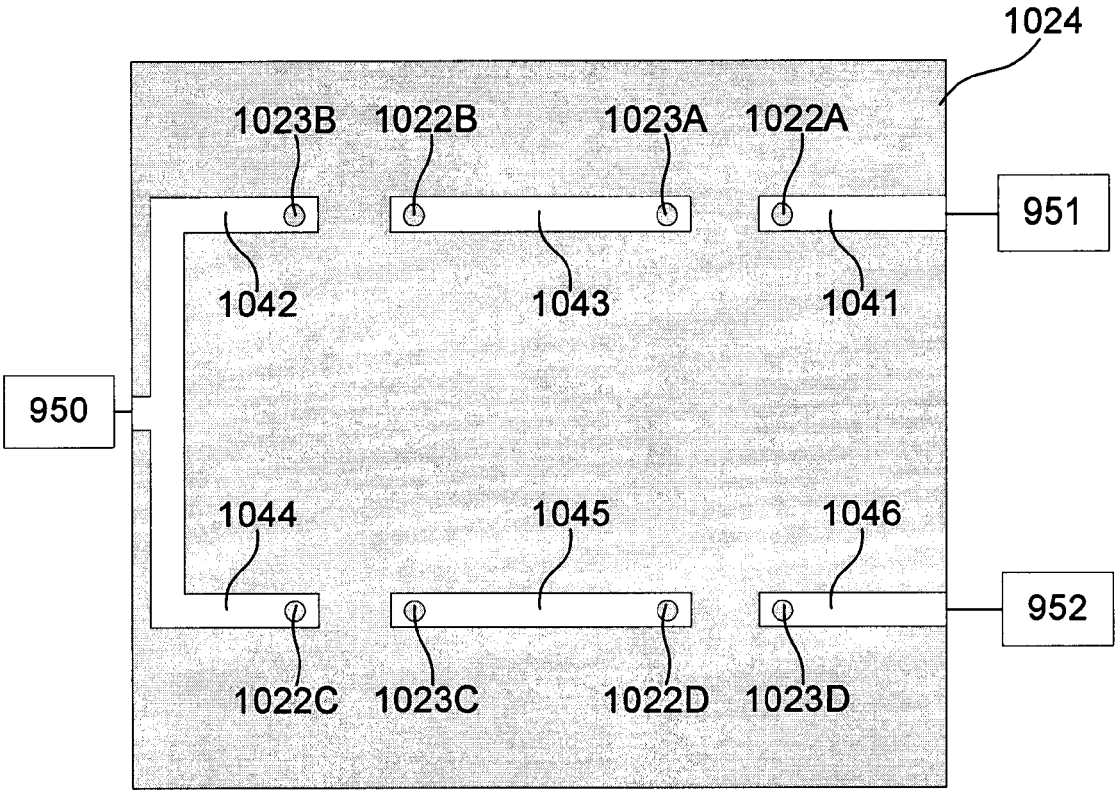

It will be appreciated that the filters 900A, 900B can be implemented in any suitable manner. In one example, each filter 900 includes two resonator bodies provided in series, with the four resonator bodies mounted on a common substrate, as will now be described with reference to FIGS. 14A to 14C.

In this example, multiple resonator bodies 1010A, 1010B, 1010C, 1010D can be provided on a common multi-layer substrate 1020, thereby providing transmit filter 900A formed from the resonator bodies 1010A, 1010B and a receive filter 900B formed from the resonator bodies 1010C, 1010D.

As in previous examples, each resonator body 1010A, 1010B, 1010C, 1010D is associated with a respective coupling structure 1030A, 1030B, 1030C, 1030D provided by a corresponding cut-out 1033A, 1033B, 1033C, 1033D in a ground plane 1021. Each coupling structure 1030A, 1030B, 1030C, 1030D includes respective input and output coupling paths 1031A, 1032A, 1031B, 1032B, 1031C, 1032C, 1031D, 1032D, which are similar in form to those described above with respect to FIG. 1D, and will not therefore be described in any detail. However, it will be noted that the coupling structures 1030A, 1030B, for the transmitter 951 are different to the coupling structures 1030C, 1030D for the receiver 952, thereby ensuring that different filtering characteristic are provided for the transmit and receive channels, as described for example with respect to FIG. 13B.

Connections 1022A, 1023A, 1022B, 1023B, 1022C, 1023C, 1022D, 1023D couple the coupling paths 1031A, 1032A, 1031B, 1032B, 1031C, 1032C, 1031D, 1032D, to paths on an internal layer 1024 of the substrate 1020. In this regard, an input 1041 is coupled via the connection 1022A to the coupling path 1031A. A connecting path 1043 couples the coupling paths 1032A, 1031B, via connections 1023A, 1022B, with the coupling path 1023B being coupled to an output 1042, and hence the antenna 950, via a connection 1023B. Similarly an input 1044 from the antenna 950 is coupled via the connection 1022C to the input coupling path 1031C. A connecting path 1045 couples the coupling paths 1032C, 1031D, via connections 1023C, 1022D, with the coupling path 1022D being coupled to an output 1046, and hence the receiver 952, via a connection 1023D.

Accordingly, the above described arrangement provides a cascaded duplex filter arrangement. The lengths of the transmission lines can be chosen such that the input of each appears like an open circuit at the centre frequency of the other. To achieve this, the filters are arranged to appear like 50 ohm loads in their pass bands and open or short circuits outside their pass bands.

It will be appreciated however that alternative arrangements can be employed, such as connecting the antenna to a common resonator, and then coupling this to both the receive and transmit filters. This common resonator performs a similar function to the transmission line junction above.

Accordingly, the above described filter arrangements use a multimode filter described by a parallel connection, at least within one body. The natural oscillation modes in an isolated body are identical with the global eigenmodes of that body. When the body is incorporated into a filter, a parallel description of the filter is the most useful one, rather than trying to describe it as a cascade of separate resonators.

The filters can not only be described as a parallel connection, but also designed and implemented as parallel filters from the outset. The coupling structures on the substrate are arranged so as to controllably couple with prescribed strengths to all of the modes in the resonator body, with there being sufficient degrees of freedom in the shapes and arrangement of the coupling structures and in the exact size and shape of the resonator body to provide the coupling strengths to the modes needed to implement the filter design. There is no need to introduce defects into the body shape to couple from mode to mode. All of the coupling is done via the coupling structures, which are typically mounted on a substrate such as a PCB. This allows us to use a very simple body shape without cuts of bevels or probe holes or any other complicated and expensive departures from easily manufactured shapes.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

Throughout the above examples, it is described that the coupling structures include one or more coupling paths. According to the requirements of the filter design, such coupling paths may be designed to resonate at a frequency corresponding to the frequency of the input signal provided to an input coupling path or the frequency of the filtered signal provided from an output coupling path as required. Use of the filter in this way may be beneficial in particular circumstances, but in other circumstances it may be preferred to use the coupling structures at frequencies where they are not resonant.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A multi-mode cavity filter comprising:

a dielectric resonator, said dielectric resonator including a piece of dielectric material, said piece of dielectric material having a substantially cubic shape having six sides, whereby said dielectric resonator is capable of supporting multiple degenerate resonant modes in parallel, said piece of dielectric material being free of cutouts and coupling structures extending therewithin;

a covering of conductive material on five of said six sides of said piece of dielectric material, wherein said sixth side of said piece of dielectric material is not covered by said conductive material except around a perimeter thereof so as to form an aperture allowing signals to be input to and output from said dielectric resonator;

a planar coupling structure extending adjacent to said sixth side of said piece of dielectric material within said aperture for coupling to said multiple degenerate resonant modes in parallel for at least one of coupling input signals to the dielectric resonator and extracting filtered output signals from the dielectric resonator; and a printed circuit board structure having at least one ground plane layer, said sixth side of said piece of dielectric material not covered by said conductive material being in contact with said at least one ground plane layer of said printed circuit board structure so that said at least one ground plane layer is electrically coupled to the covering of conductive material around said perimeter of said sixth side, said planar coupling structure being completely between said piece of dielectric material and said printed circuit board structure, said at least one ground plane layer covering said aperture to minimize any leakage of electromagnetic energy from said dielectric resonator.

2. The multi-mode cavity filter according to claim 1, wherein said multiple degenerate resonant modes are at least a first resonant mode and at least a second substantially degenerate resonant mode.

3. The multi-mode cavity filter according to claim 1, wherein said sixth side of said piece of dielectric material not covered by said conductive material is flat.

4. The multi-mode cavity filter according to claim 1, wherein the coupling structure comprises a first electrical connection on said sixth side of said piece of dielectric material not covered by said conductive material and a second electrical connection on a layer of the printed circuit board structure.

5. The multi-mode cavity filter according to claim 4, wherein the second electrical connection is arranged on an outermost layer of the printed circuit board structure.

6. The multi-mode cavity filter according to claim 5, wherein the second electrical connection is coupled to an inner signal layer of the printed circuit board structure.

7. The multi-mode cavity filter according to claim 1, wherein the coupling structure comprises at least one conductive track arranged on a surface of the dielectric resonator.

8. The multi-mode cavity filter according to claim 7, wherein the at least one conductive track comprises a first portion for at least one of coupling the input signals to and extracting the filtered output signals from a first resonant mode of the multiple degenerate resonant modes of the dielectric resonator and a second portion for at least one of coupling the input signals to and extracting the filtered output signals from a second resonant mode of the multiple degenerate resonant modes of the dielectric resonator.

9. The multi-mode cavity filter according to claim 1, wherein the at least one ground plane layer comprises a first ground plane layer electrically connected to the covering of conductive material and at least a second ground plane layer electrically coupled to the first ground plane layer.

10. The multi-mode cavity filter according to claim 9, wherein the first and second ground plane layers are electrically coupled such that the energy leakage from the dielectric resonator is reflected back into the dielectric resonator.

11. The multi-mode cavity filter according to claim 9, wherein the first ground plane layer is continuously electrically coupled to the covering of conductive material around the perimeter of said sixth side of said piece of dielectric material not covered by said conductive material.

12. The multi-mode cavity filter according to claim 9, wherein the coupling structure is electrically connected to an inner signal layer of the printed circuit board structure by a connection which passes through said first and second ground plane layers.

13. The multi-mode cavity filter according to claim 1, wherein the printed circuit board structure comprises a first printed circuit board and a second printed circuit board electrically coupled to each other.

* * * * *